US009451840B2

(12) United States Patent
Richert

(10) Patent No.: US 9,451,840 B2
(45) Date of Patent: Sep. 27, 2016

(54) BUBBLE GENERATION NOVELTY ITEM

(71) Applicant: Jonas Richert, Mesa, AZ (US)

(72) Inventor: Jonas Richert, Mesa, AZ (US)

( * ) Notice: Subject to any disclaimer, the term of this patent is extended or adjusted under 35 U.S.C. 154(b) by 0 days.

(21) Appl. No.: 15/068,256

(22) Filed: Mar. 11, 2016

(65) Prior Publication Data

US 2016/0192796 A1 Jul. 7, 2016

Related U.S. Application Data

(62) Division of application No. 13/585,682, filed on Aug. 14, 2012, now Pat. No. 9,293,072.

(51) Int. Cl.

| | |
|---|---|
| ***A47G 19/22*** | (2006.01) |
| ***F28D 15/02*** | (2006.01) |
| ***G09F 13/24*** | (2006.01) |

(52) U.S. Cl.

CPC ..... *A47G 19/2233* (2013.01); *F28D 15/02* (2013.01); *G09F 13/24* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,895,636 A * | 7/1959 | Martin | A47G 19/2288 215/12.1 |
| 4,163,374 A * | 8/1979 | Moore | B65D 81/3883 220/592.01 |
| 2002/0005044 A1* | 1/2002 | Mahajan | B29C 49/0073 62/457.3 |

* cited by examiner

*Primary Examiner* — Duane Smith
*Assistant Examiner* — Adam W Bergfelder
(74) *Attorney, Agent, or Firm* — Morgan Law Offices, PLC

(57) ABSTRACT

A novelty device for generating bubbles is disclosed. Disclosed is a bubble generation drinking cup that includes a vacuum cavity within a cup sidewall, where the vacuum cavity is partially filled with one or more fluid. The fluid generates bubbles continuously in response to a temperature differential within the vacuum cavity, brought on by a cold or hot liquid being present in the cup. A vial bubble generation ornament is disclosed that includes a tubular vial enclosing a vacuum cavity and a bubble generation capsule. The vacuum cavity is partially filled with a fluid. The bubble generation capsule generates bubbles in response to receiving sunlight. A bubble generation panel is disclosed that includes a vacuum cavity enclosed between two glass panes. The vacuum cavity includes a fluid which generates bubbles in response to receiving heat. The bubbles and fluid in the vacuum cavity create a visually appealing novelty device.

19 Claims, 16 Drawing Sheets

BUBBLE GENERATION NOVELTY ITEM

CROSS REFERENCE TO RELATED APPLICATION

This application is a divisional of Ser. No. 13/585,682, pending, filed Aug. 14, 2012, by Jonas Richert and entitled "Bubble Generation Novelty Item," which claims priority to U.S. Provisional Patent Application Ser. No. 61/526,236, filed Aug. 22, 2011, each of which is incorporated herein by reference in its entirety.

BACKGROUND OF THE INVENTION

1. Technical Field

This invention relates to novelty items and in particular to novelty items that generate bubbles in a fluid.

2. State of the Art

Novelty items are manufactured items usually used for personal or household adornment. Novelty items are often decorative, unusual, and may or may not serve a useful function. Household novelty items are meant to be items that attract attention and/or are conversation pieces, from attractive sculptures and pieces of art to unusual eye-catching devices like a lava lamp. Liquid, light, and bubbles are often used to make attractive novelty items. Bubbling fluid has been used to create very popular decorative items, such as bubble Christmas lights, but these devices each have their own individual drawbacks, such as they are expensive and complicated to manufacture, or they are not interesting and changeable enough to receive continued attention. There is a continuing need for bubble generation novelty devices that are clever, inexpensive, and eye-catching. Therefore, this document explains several embodiments of bubble generation novelty devices that are novel, visually appealing, inexpensive to manufacture, energy efficient and can be made in any size.

DISCLOSURE OF THE INVENTION

The disclosed invention relates to novelty items and in particular to novelty items that generate bubbles in a fluid. Disclosed is a bubble generation drinking cup that includes a cup bottom and a cup sidewall. The cup sidewall includes an inner cup sidewall, where the inner cup sidewall comprises an inner cup sidewall inner surface and an inner cup sidewall outer surface; an outer cup sidewall, where the outer cup sidewall comprises an outer cup sidewall inner surface and an outer cup sidewall outer surface; a vacuum cavity in between the inner cup sidewall and the outer cup sidewall, where the vacuum cavity is enclosed by the outer cup sidewall inner surface, the inner cup sidewall outer surface, a vacuum cavity top end, and a vacuum cavity bottom end; and a fluid, where the fluid partially fills the vacuum cavity. The bubble generation drinking cup also includes a heat transfer path, where the heat transfer path thermally couples a liquid placed into the bubble generation drinking cup with the vacuum cavity. In some embodiments the heat transfer path thermally couples a liquid that is poured into the bubble generation drinking cup to a top portion of the vacuum cavity. In some embodiments the thermal transfer path couples a liquid that has been poured into the bubble generation drinking cup to an upper portion of the inner cup sidewall. In some embodiments the thermal transfer path couples a liquid that has been poured into the bubble generation drinking cup to the vacuum cavity bottom end. In some embodiments the thermal transfer path couples the cup bottom to the vacuum cavity bottom end.

In some embodiments of the bubble generation drinking cup, the fluid boils in response to a liquid being poured into the drinking cup. In some embodiments, the fluid boils in response to a warm liquid being poured into the drinking cup. In some embodiments, the fluid boils in response to a cool liquid being poured into the drinking cup. In some embodiments the bubble generation drinking cup further comprises an insulating liner. In some embodiments the insulating liner covers the inner cup sidewall inner surface, and the insulating liner minimizes thermal coupling between a liquid held in the drinking cup and the inner cup sidewall inner surface. In some embodiments the insulating liner covers the cup bottom, and the insulating liner minimizes thermal transfer between a liquid held in the drinking cup and the cup bottom. In some embodiments the bubble generation drinking cup includes a cup liner layer, wherein the cup liner layer covers the cup bottom and an insulating liner inner surface. In some embodiments of the bubble generation drinking cup, the vacuum cavity includes a bubble nucleation device at the vacuum cavity bottom end. In some embodiments of the bubble generation drinking cup, the vacuum cavity includes a mobile bubble nucleation device. In some embodiments of the bubble generation drinking cup, the outer cup sidewall is at least partially transparent. In some embodiments of the bubble generation drinking cup, the fluid is a first fluid, and the cup sidewall further comprises a second fluid inside the vacuum cavity, where the first fluid and the second fluid are immiscible.

Disclosed is a vial bubble generation ornament that comprises a hollow elongate vial wall hermetically sealed at a vial top end and a vial bottom end; a vacuum cavity enclosed by the vial wall; a fluid, where the fluid partially fills the vacuum cavity; and a bubble generator capsule, where the bubble generator capsule releases bubbles in response to receiving sunlight. In some embodiments the bubble generator capsule is positioned at the vial bottom end. In some embodiments the hollow elongate vial wall is a hollow tubular vial wall. In some embodiments the hollow elongate vial wall is a hollow rectangular vial wall. In some embodiments the fluid includes water and alcohol. In some embodiments the fluid includes water, alcohol, and salt. In some embodiments the fluid includes a mixture of water and alcohol, where the mixture is 10 percent by volume of alcohol. In some embodiments the mixture includes 0.1 to 2 molar concentration of an inorganic salt. In some embodiments the vacuum cavity had a width at its narrowest point of between 1 and 5 mm.

In some embodiments the bubble generator capsule includes a sunlight absorption layer and a wick. In some embodiments of the vial bubble generation ornament, the sunlight absorption layer covers a bottom portion of the vial wall outer surface. In some embodiments the bubble generator capsule further comprises a weight, wherein the weight is coupled to a first end of the wick, and wherein the weight holds the first end of the wick at the vial bottom end. In some embodiments the bubble generator capsule further comprises porous material coupled to the wick. In some embodiments the bubble generator capsule includes a non-polar material coupled to the wick. In some embodiments the bubble generator capsule includes a hollow tube of material with a hollow tube top end and a hollow tube bottom end, where the hollow tube of material comprises the sunlight absorption layer, and where the hollow tube of material is positioned inside the vacuum cavity at the vial bottom end. In some embodiments the bubble generator capsule includes a hollow tube bottom cap coupled to the hollow tube bottom end, where the hollow tube bottom cap comprises a non-polar material. In some embodiments a first end of the wick is coupled to the hollow tube bottom cap. In some embodiments a second end of the wick protrudes from the hollow tube top end.

Disclosed is a bubble generation panel that includes a vacuum panel, a base, and a light source. The vacuum panel includes a front pane, a rear pane, and a vacuum cavity defined by the front pane and the rear pane. The vacuum cavity also includes a first fluid partially filling the vacuum cavity. In some embodiments the vacuum panel also includes a bubble nucleation device inside the vacuum cavity. The base includes a slot for receiving a bottom end of the vacuum panel. The base also includes a light source that emits light. Light emitted by the light source is incident on the bottom end of the vacuum panel. In some embodiments the bubble generation panel according to the invention includes a heat source in the base. In some embodiments the light source is also the heat source. In some embodiments the vacuum panel further comprises one or more than one spacer post. In some embodiments the vacuum panel further comprises a second fluid partially filling the vacuum cavity, wherein the first and the second liquid are immiscible. In some embodiments the vacuum panel further comprises sand, wherein the sand is inside the vacuum cavity. In some embodiments the vacuum panel further comprises one or more than one baffle inside the vacuum cavity.

Disclosed is a method of forming a bubble generation novelty cup. The method of forming a bubble generation novelty cup according to the invention includes the step of forming a cup sidewall, where the cup sidewall includes an inner cup sidewall, an outer cup sidewall, and a vacuum cavity defined by the inner cup sidewall and the outer cup sidewall. In some embodiments the vacuum cavity is between the inner cup sidewall and the outer cup sidewall. The method of forming a bubble generation novelty cup according to the invention also includes the step of partially filling the vacuum cavity with a fluid, and the step of coupling a cup bottom to the cup sidewall, such that a heat transfer path is formed between the cup bottom and a vacuum cavity bottom end. In some embodiments the vacuum cavity includes a bubble generation device. In some embodiments the vacuum cavity includes a mobile bubble generation device. In some embodiments the method of forming a bubble generation novelty cup according to the invention includes the step of lining an inner surface of the inner cup sidewall with an insulating liner. In some embodiments the method of forming a bubble generation novelty cup according to the invention includes the step of lining the cup bottom and a lower section of the inner cup sidewall with an insulating liner. In some embodiments the method of forming a bubble generation novelty cup according to the invention includes the step of covering an inner surface of the insulating liner with a cup liner layer.

The foregoing and other features and advantages of the invention will be apparent to those of ordinary skill in the art from the following more particular description of the invention and the accompanying drawings.

DETAILED DESCRIPTION OF EMBODIMENTS OF THE INVENTION

Figure 1:
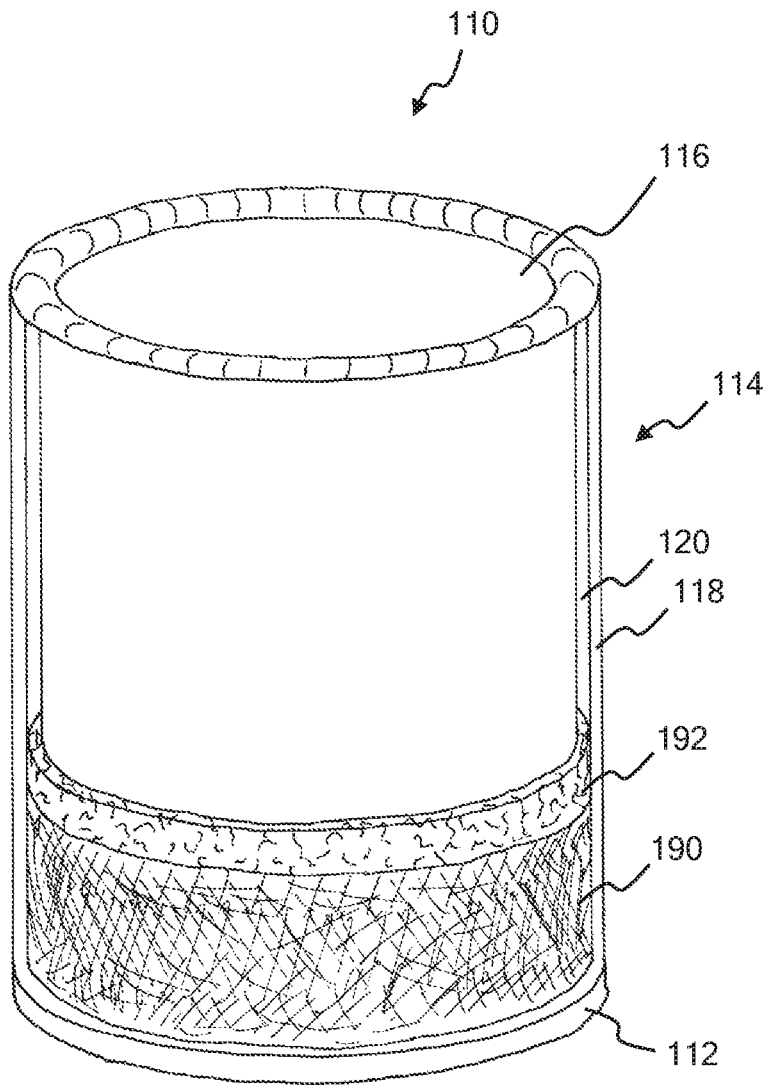
FIG. 1 is a side perspective view of an embodiment of bubble generation drinking cup 110 according to the invention.

As discussed above, embodiments of the present invention relate to novelty items and in particular to novelty items that generate bubbles in a fluid. Disclosed are embodiments of bubble generation novelty items that generate bubbles in a fluid using novel elements and methods, and that result in attractive, eye-catching, and inexpensive novelty items that can be made in many sizes and shapes. In the case of the drinking cups intended for use with hot beverages, an additional advantage is that the novel behavior of the cups effectively modulate the temperature of a hot liquid to quickly drop to the upper range of acceptable drinking temperature, then maintain the liquid in that temperature range longer than uninsulated cups. Further, an undisturbed cup will quickly develop a pronounced cool layer of liquid at the bottom due to the thermal coupling of the bottom layers to the vacuum cavity, which distributes this heat through the process of boiling. The resulting stratified cool layer of fluid at the cup bottom dramatically slows heat loss of the liquid during a time when the cup is unused, keeping the beverage warm for later consumption.

Bubble generation novelty items according to the invention use a temperature gradient within a vacuum cavity to boil a fluid that is enclosed in the vacuum cavity. The temperature gradient within the vacuum cavity creates a temperature gradient within the fluid in the vacuum cavity. The combination of a temperature gradient within the fluid and gravity drives a cycle of boiling that can generate complex and visually appealing patterns. The fluid can be made to boil at room temperature and generate bubbles with a relatively small temperature gradient because the fluid is enclosed in a chamber of low atmospheric pressure—often a vacuum cavity. The vacuum cavity has a width that is small as compared to its length and height. The narrow width of the vacuum cavity in relation to the larger surface area of the vacuum cavity inhibits heat exchange by means of convection within the fluid within the vacuum cavity to such a degree that vapor pressure supersaturation reaches a level at which bubbles begin to form. This temperature differential between different portions of the vacuum cavity and the fluid within the vacuum cavity causes the fluid to boil and release bubbles, often at bubble nucleation sites. The bubbles travel from the higher temperature region to the lower-temperature region. The bubbles then condense in the lower-temperature region and the condensed fluid returns to the main body of boiling fluid to regenerate the cycle of boiling. Colored fluids, different types of fluids, light emitting devices, baffles, dyes, particles and other elements can add to the visual effects.

One embodiment of the bubble generation novelty item according to the invention that is described in this document is a bubble generation drinking cup. The bubble generation drinking cup includes a vacuum cavity in the sidewall of the drinking cup, and a fluid within the vacuum cavity. In some embodiments of the bubble generation drinking cup, the fluid in the vacuum cavity boils in response to a hot liquid being poured into the drinking cup. In some embodiments of the bubble generation drinking cup, the fluid in the vacuum cavity boils in response to a cold liquid being poured into the drinking cup. In some embodiments a thermally insulating liner is used to restrict thermal transfer through the inner sidewall of the drinking cup. In some embodiments a thermal transfer path is formed between the bottom of the drinking cup and the bottom end of the vacuum cavity. When a hot liquid is poured in the drinking cup, the hot liquid warms the bottom only of the vacuum cavity, creating a temperature differential between the top end of the vacuum cavity and the bottom end of the vacuum cavity. The temperature differential within the vacuum cavity causes a temperature differential between different regions of the fluid within the vacuum cavity. The fluid residing inside the vacuum cavity experiences a pronounced difference of vapor pressure caused by this temperature differential. The fluid inside the vacuum cavity then boils, creating bubbles which rise inside the vacuum cavity along the cup sidewall and then condenses at or near the top end of the vacuum cavity, creating an active bubbling effect in the cup sidewall. The bubbling within the sidewalls continues until the thermal gradient between the outer cup sidewall—as determined by the ambient temperature—and the vacuum cavity bottom—as determined by the temperature of the fluid—is too small to cause boiling. In another embodiment of the bubble generation drinking cup according to the invention, the thermal transfer path thermally couples a cold liquid that is poured into the cup to the upper end of the vacuum cavity within the sidewall. An insulating liner covers the cup bottom in this embodiment, and the temperature differential between the vacuum cavity bottom end and vacuum cavity top end exists because the vacuum cavity bottom end is at ambient temperature, as the vacuum cavity top end is thermally coupled to the cold liquid and is therefore cold. In both embodiments the fluid within the vacuum cavity boils in response to a liquid being placed in the drinking cup.

In another embodiment of a bubble generation novelty item, a vial bubble generation ornament is described. An elongate transparent or semi-transparent vial is hermetically sealed at the vial top end and the vial bottom end to create an interior cavity. The cavity is evacuated to create a vacuum cavity. A fluid and a bubble generation capsule are enclosed within the vacuum cavity. In one embodiment the bubble generation capsule is formed to absorb heat, such as from incident sunlight. In a particular embodiment the vial is hung vertically such that the bubble generation cavity resides at the vacuum cavity bottom end. Sunlight falling on the bubble generation capsule causes the bubble generation capsule to heat up and boil the fluid to release bubbles into the enclosed fluid. The bubbles travel slowly along the vial from bottom to top, creating an appealing visual effect in the sunlight, as well as serving as a visual reference for the current environmental conditions, as the boiling and overall behavior of the vial ornament is directly influenced by factors such as sun inclination, cloudiness, wind speed, and temperature.

A third embodiment of a bubble generation novelty item disclosed in this document is a bubble generation panel. A bubble generation panel is a thin planar vacuum panel enclosing a fluid that is caused to boil. The bubble generation panel includes a thin vacuum cavity in between a front pane and a back pane of the vacuum panel, and one or more fluids inside the vacuum cavity. The fluid in the vacuum cavity boils in response to absorbing heat, and bubbles rise within the vacuum panel, distributing the heat across the panel through the endothermic process of condensation, as well as by causing fluid movement. A light source is used to illuminate the vacuum panel and its internal processes, and colored water, sand, dyes, particles, and different types of fluid can be used in the vacuum panel to emphasize and make visible the intrinsic beauty of the panel. Baffles and other structures within the vacuum cavity can direct the bubbles and fluid flow into pleasing and interesting patterns and displays. There are many different options and variations of the described invention. A few of the possible embodiments are described in detail below.

Figure 2:
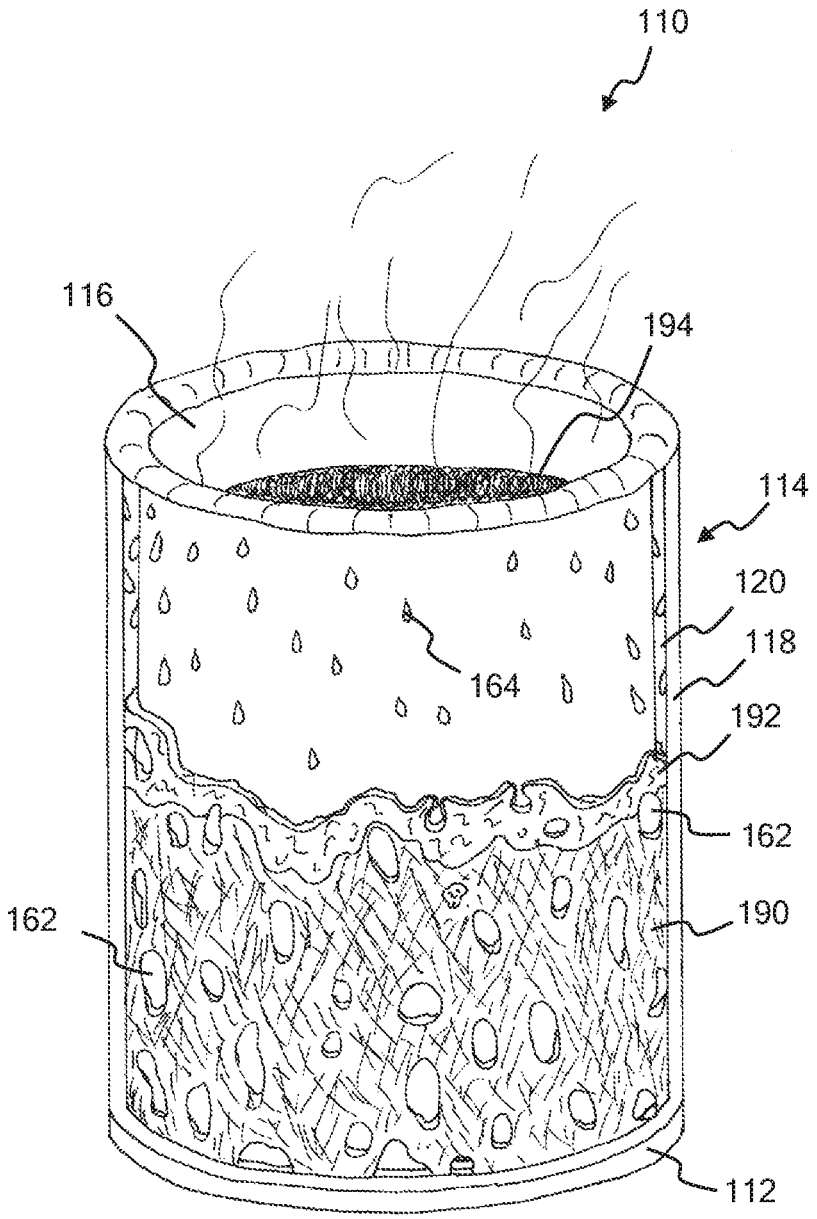
FIG. 2 is a side perspective view of bubble generation drinking cup 110 of FIG. 1 after hot liquid 194 has been added, showing how fluid 190 boils, creating bubbles 162 and condensation droplets 164 in vacuum cavity 120, in response to hot liquid 194 being poured into bubble generation drinking cup 110.

FIG. 1 and FIG. 2 show an embodiment of bubble generation drinking cup 110 (drinking cup 110 or cup 110) according to the invention. FIG. 1 shows bubble generation drinking cup 110 at rest, with no bubble activity. FIG. 2 shows bubble generation drinking cup 110 after a hot liquid 194 has been poured into cup 110, causing first fluid 190 to boil and create bubbles 162, which rise through first fluid 190 and second fluid 192 to the upper end of vacuum cavity 120, where bubbles 162 condense inside vacuum cavity 120 to form condensation droplets 164, which fall back into first fluid 190. The bubbling action of first fluid 190 lasts as long as the temperature of hot liquid 194 is elevated enough to cause a temperature differential within vacuum cavity 120. The bubbling activity creates an interesting and visually pleasing display to watch while using cup 110, while also partially insulating the cup to a degree that makes it touchable without further need of insulation. Further, a cool layer of liquid 194 sitting at the bottom of cup 100 develops after a few minutes when cup 110 and liquid 194 are not disturbed, dramatically increasing the insulation value of cup 110 and holding liquid 194 at an elevated temperature during the period of inactivity. Cup 110 as shown in the drawings is shown without a cup handle or lid, but it is to be understood that cup 110 can include a cup handle, lid, or both, as is known in the art for making drinking cups.

Figure 3:
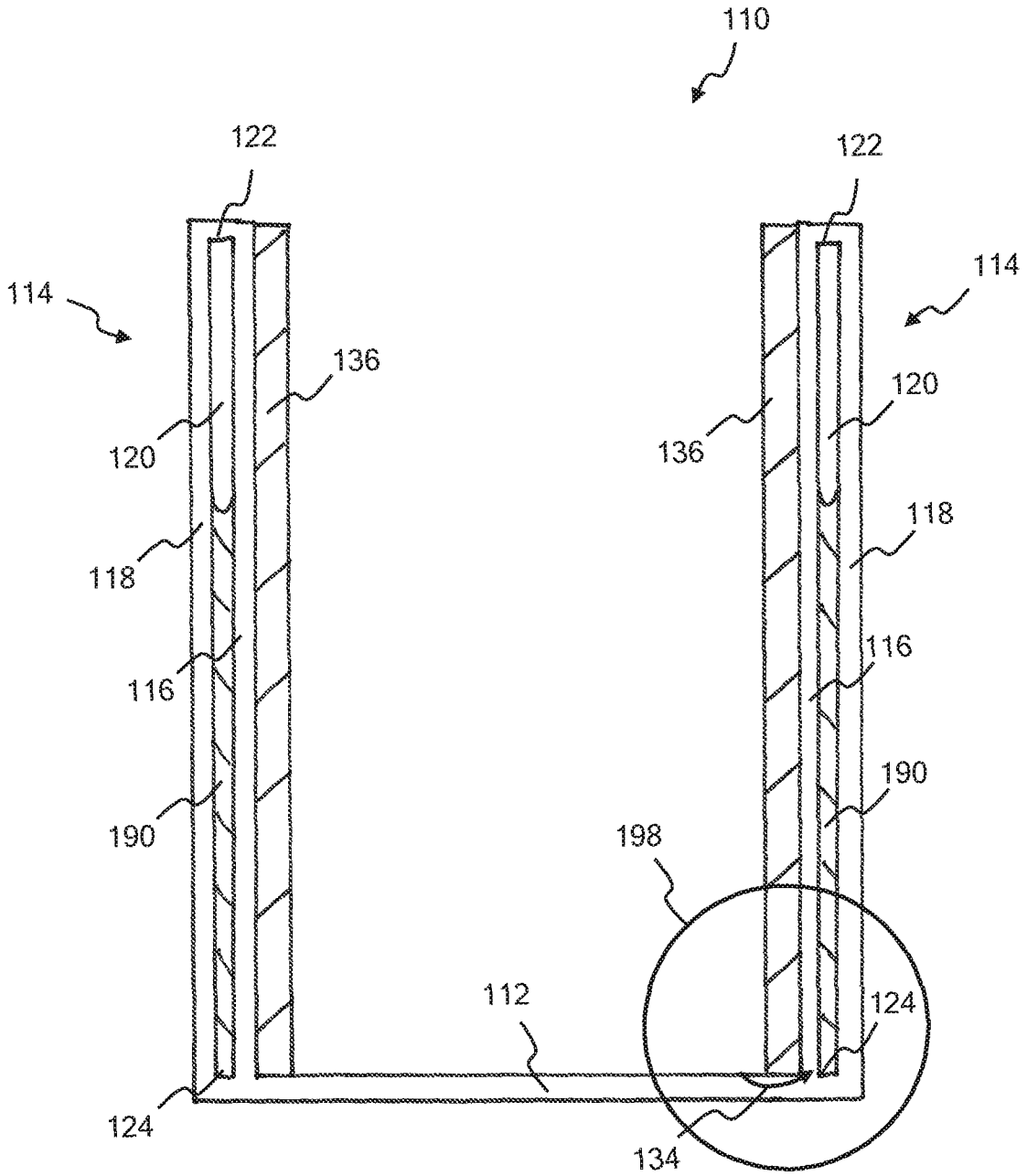
FIG. 3 is a cross-sectional view of an embodiment of bubble generation drinking cup 110 according to the invention.
Figure 4:
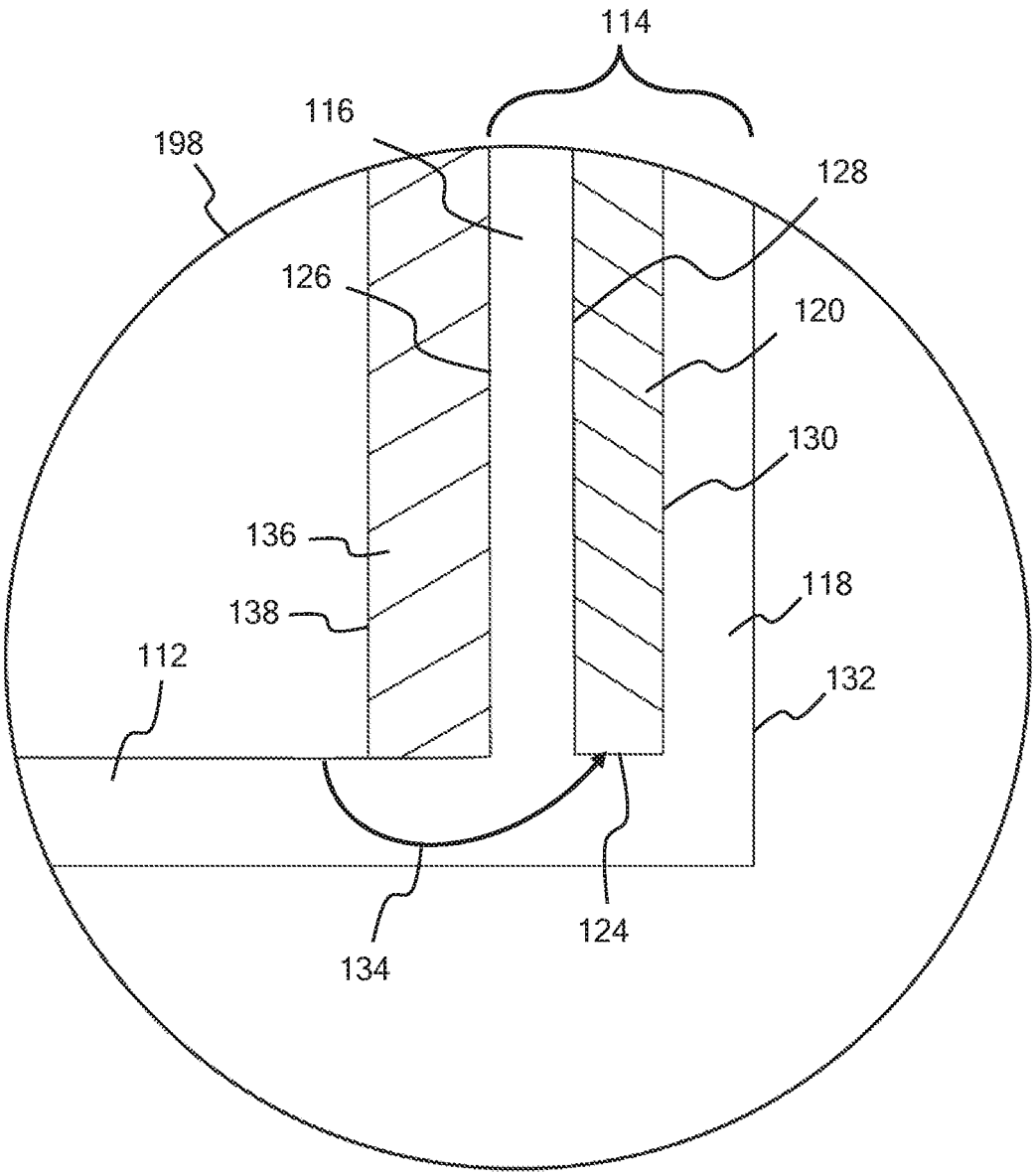
FIG. 4 is a close-up cross section of section 198 of bubble generation drinking cup 110 of FIG. 3, showing how cup bottom 112 and vacuum cavity bottom end 124 are thermally coupled by heat transfer path 134.
Figure 5:
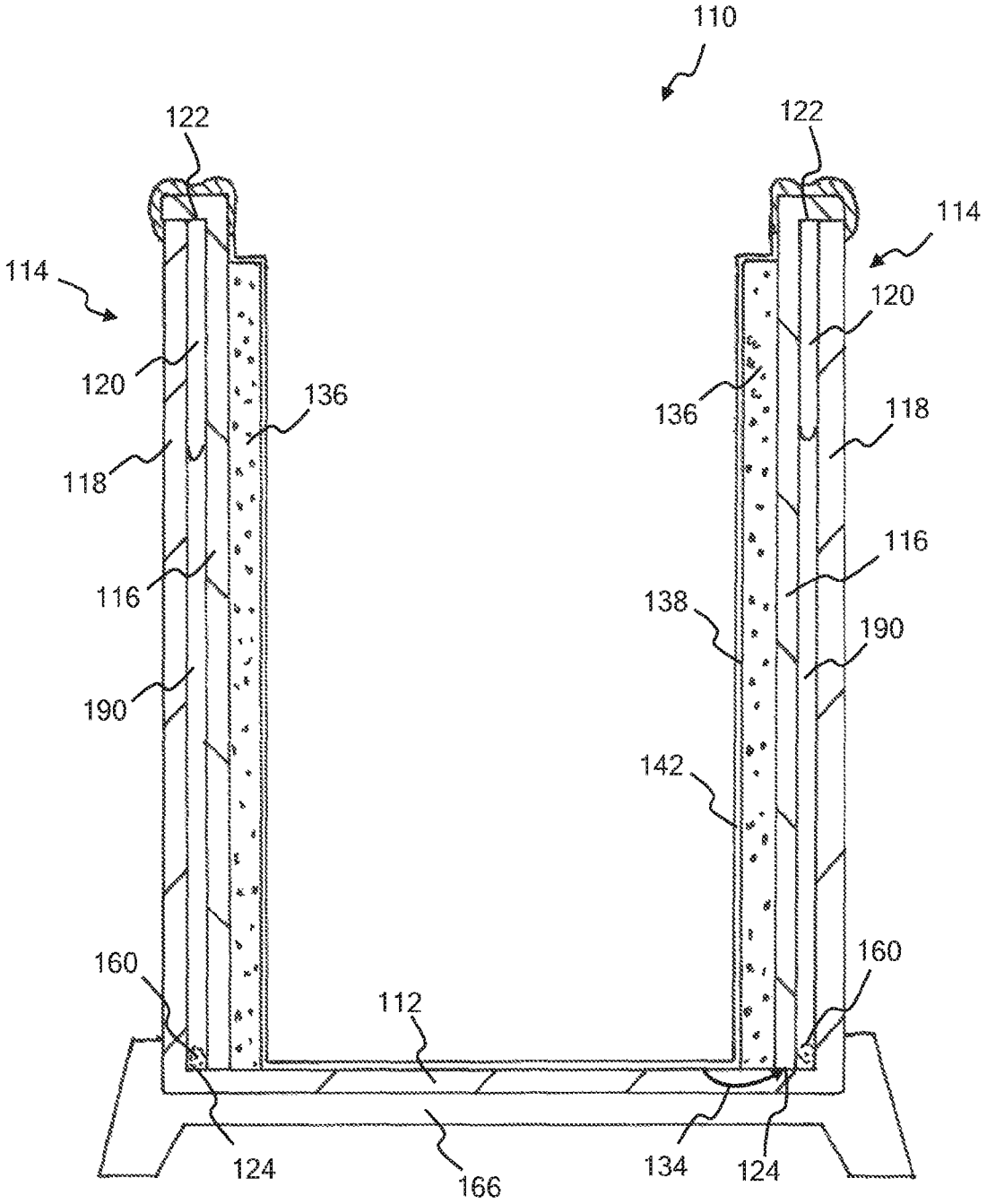
FIG. 5 is a side view cross section of another embodiment of bubble generation drinking cup 110 according to the invention.
Figure 6:
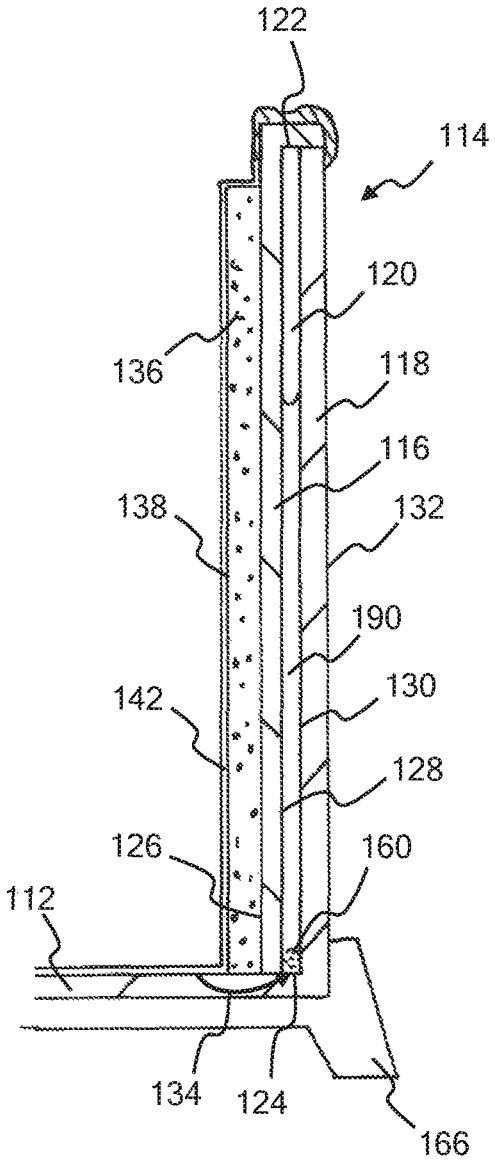
FIG. 6 is a close-up cross section of cup sidewall 114 of bubble generation drinking cup 110 of FIG. 5.
Figure 7:
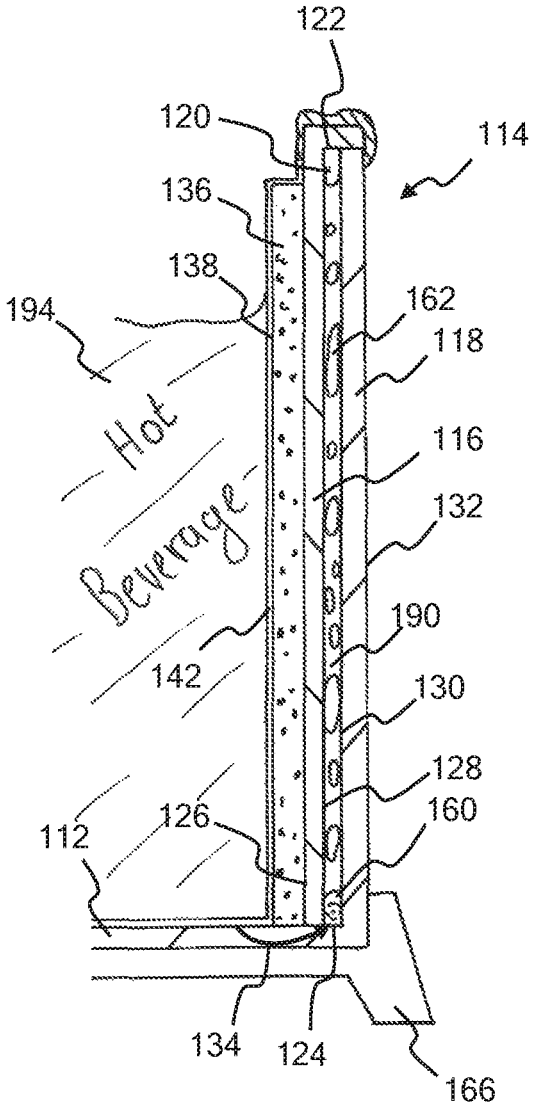
FIG. 7 is a close-up cross section of cup sidewall 114 of bubble generation drinking cup 110 of FIG. 5 after hot liquid 194 has been poured into bubble generation drinking cup 110, showing bubbles 162 that are generated at bubble generation device 160 in response to hot liquid 194 being poured into bubble generation drinking cup 110.
Figure 8:
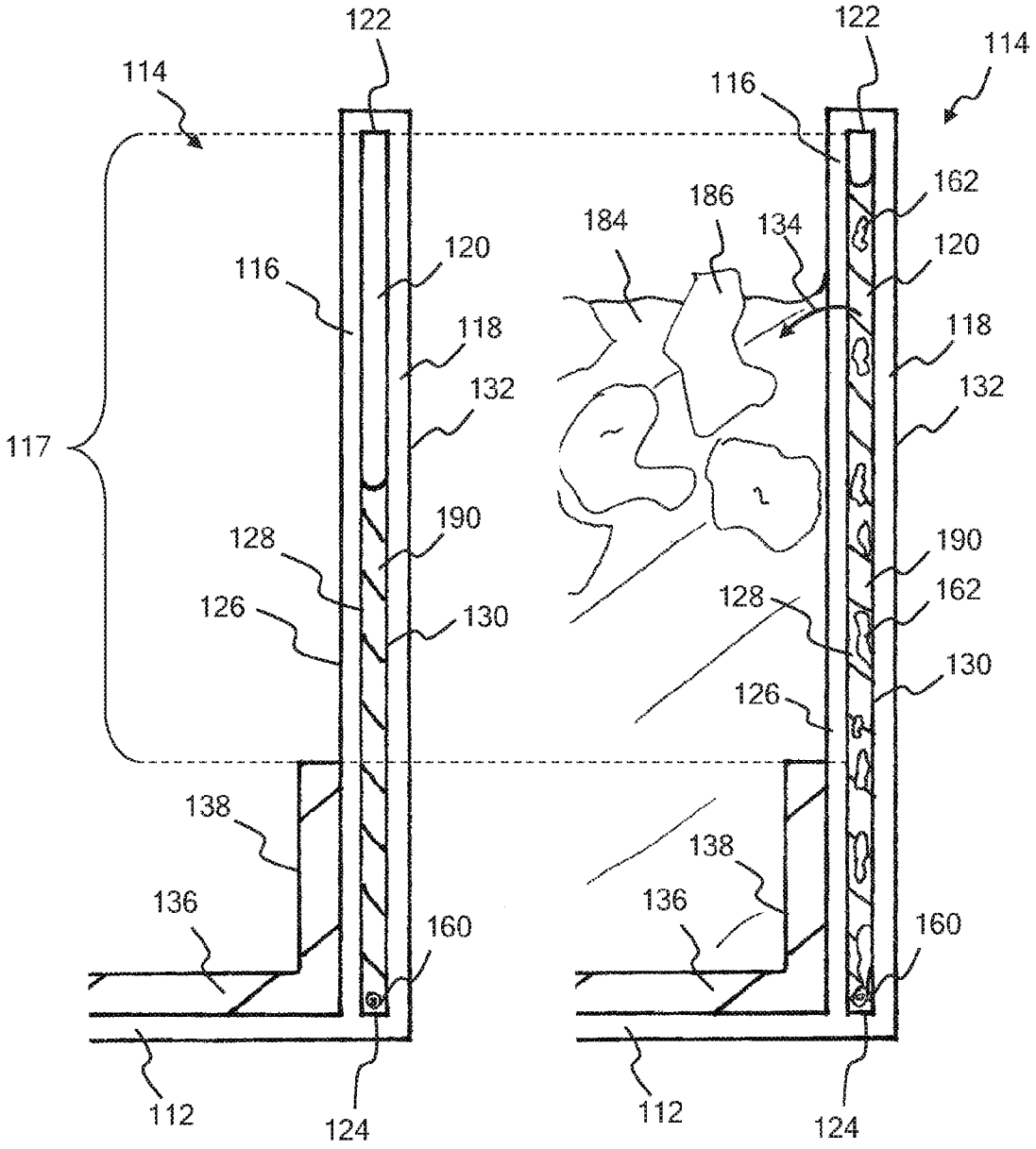
FIG. 8 is a side view cross section of another embodiment of cup sidewall 114 according to the invention of bubble generation cup 110 according to the invention. In this embodiment of bubble generation cup 110, bubble nucleation device 160 generates bubbles 162 in vacuum cavity 120 when cold liquid 184 is poured into cup 110.

FIG. 3 shows a side view cross section of one embodiment of cup 110 according to the invention. FIG. 4 shows an expanded view of section 198 of FIG. 3. FIG. 5 shows a side view cross section of another embodiment of cup 110 according to the invention. FIG. 6 and FIG. 7 show a close-up side view cross section of cup 110 of FIG. 5. FIG. 6 shows cup 110 of FIG. 5 at rest, and FIG. 7 shows cup 110 of FIG. 5 with fluid 190 in a boiling state in response to hot liquid 194 being placed into cup 110. FIG. 8 shows an embodiment of cup sidewall 114 designed to bubble in response to receiving cold liquid 184.

Cup 110 according to the invention as shown in FIG. 1 through FIG. 8 includes cup bottom 112 and cup sidewall 114. Cup sidewall 114 includes inner cup sidewall 116, outer cup sidewall 118, vacuum cavity 120 between inner cup sidewall 116 and outer cup sidewall 118, and one or more than one fluid 190 and/or 192. The one or more than one fluid 190, 192 partially fills vacuum cavity 120. Cup 110 according to the invention also includes heat transfer path 134. Heat transfer path 134 can take many forms. Heat transfer path 134 is used to thermally couple liquid 194 that is poured into cup 110 to vacuum cavity 120. Heat transfer path 134 thermally couples liquid 194 to either vacuum cavity top end 122 or vacuum cavity bottom end 124, depending on whether cup 110 is designed to create bubbles in response to receiving hot liquid 194 or cold liquid 184. In the embodiments shown in FIG. 1 through FIG. 7, thermal transfer path 134 thermally couples liquid 194 and cup bottom 112 to vacuum cavity bottom end 124. In this embodiment cup 110 is designed to cause bubbles in response to receiving a warm or hot liquid 194 in cup 110. In the embodiments shown in FIG. 8, thermal transfer path 134 thermally couples liquid 184 to upper portion 117 of vacuum cavity 120.

Cup sidewall 114 includes vacuum cavity 120. Vacuum cavity 120 can be included in cup sidewall 114 in many different ways according to the visual effect desired. In the embodiments shown, cup sidewall 114 includes inner cup sidewall 116 and outer cup sidewall 118, with vacuum cavity 120 in between inner cup sidewall 116 and outer cup sidewall 118. Outer cup sidewall 118 is often transparent or partially transparent, so the bubbling action of fluid 190 can be seen. In some embodiments both inner cup sidewall 116 and outer cup sidewall 118 are fully or partially transparent. In some embodiments vacuum cavity 120 has a width of between 0.1 millimeters to 5 millimeters from inner cup sidewall outer surface 128 to outer cup sidewall inner surface 130. This width has been found to be useful because it results in a vacuum cavity 120 which has a longer length (from vacuum cavity top end 122 to vacuum cavity bottom end 124) than its width. The small width minimizes heat convective movement of fluid 190 within vacuum cavity 120, which promotes the generation of bubbles 162 in response to a temperature gradient within vacuum cavity 120 and fluid 190.

In the embodiments shown in FIG. 1 through FIG. 8, inner cup sidewall 116 and outer cup sidewall 118 are two nested hollow cylinders with a space between them. The top and the bottom of the space are hermetically sealed at vacuum cavity top end 122 and vacuum cavity bottom end 124 to create a sealed cavity, which is evacuated to create vacuum cavity 120. First fluid 190 and/or second fluid 192 are placed inside vacuum cavity 120. In the embodiments shown, first fluid 190 and/or second fluid 192 partially fill vacuum cavity 120. In this embodiment inner cup sidewall 116 includes inner cup sidewall inner surface 126 (See FIG. 4), and inner cup sidewall outer surface 128. Outer cup sidewall 118 includes outer cup sidewall inner surface 130, and outer cup sidewall outer surface 132. Vacuum cavity 120 is enclosed by outer cup sidewall inner surface 130, inner cup sidewall outer surface 128, vacuum cavity top end 122, and vacuum cavity bottom end 124.

Cup sidewall 114 can be formed in many different ways, including as one integral piece with vacuum cavity 120 embedded in cup sidewall 114, or as several pieces that are coupled together such that vacuum cavity 120 is hermetically sealed. In some embodiments cup sidewall 114 is made with vacuum and/or filling ports in order to evacuate vacuum cavity 120 and/or fill vacuum cavity 120 with first fluid 190 and/or second fluid 192. Cup sidewall 114 can be made of glass, Plexiglas, plastic, or other such material. Cup sidewall 114 can be transparent, translucent, partially transparent or partially translucent. Vacuum cavity 120 can be many different shapes and sizes within cup sidewall 114, according to the visual effect desired.

Heat transfer path 134 provides thermal coupling between liquid 184 or 194 placed in cup 110, and a portion of vacuum cavity 120. The goal is to create a thermal gradient within vacuum cavity 120, so that fluid 190 boils. In the embodiments shown in FIG. 1 through FIG. 7, heat transfer path 134 thermally couples liquid 194 and cup bottom 112 to vacuum cavity bottom end 124. A liquid with an elevated temperature—hot or warm liquid 194—that is placed in cup 110 will increase the temperature of cup bottom 112. Cup bottom 112, or parts of it, can be made of metal, glass, or other material which transfers heat. Cup bottom 112 in the embodiment shown in FIG. 1 through FIG. 7 is formed of a thermally transmitting material which, when it touches both hot liquid 194 and vacuum cavity bottom end 124, forms thermal transfer path 134 which transfers heat from cup bottom 112 to vacuum cavity bottom end 124. This transfer of heat to vacuum cavity bottom end 124 creates a thermal gradient between vacuum cavity bottom end 124 and vacuum cavity top end 122. This thermal gradient between different portions of vacuum cavity 120 causes fluid 190 to boil and create bubbles 162.

It is to be understood that thermal transfer path 134 can have other placements. FIG. 8 shows an embodiment cup sidewall 114 which is designed to create bubbles 162 in response to receiving cool or cold liquid 184. In this example, thermal transfer path 134 transfers heat between an upper portion of vacuum cavity 120, and cold liquid 184, through upper portion 117 of cup inner sidewall 116. In this embodiment a cold liquid 184 poured into cup 110 will cool upper portion 117 of cup sidewall 116, and the upper end of vacuum cavity 120. The cooling of the upper end of vacuum cavity 120 creates the temperature differential within vacuum cavity 120, causing bubbles 162 to form.

In embodiments of bubble generation drinking cup 110, either warming vacuum cavity bottom end 124 or cooling vacuum cavity top end 122 will cause a temperature differential within vacuum cavity 120 and within fluid 190, which will cause first fluid 190 to boil and create bubbles 162. Bubble generation drinking cup 110 is formed such that fluid 190 boils in response to liquid 184 or 194 being poured into bubble generation drinking cup 110. In some embodiments bubble generation drinking cup 110 is formed such that fluid 190 boils in response to warm or hot liquid 194 being poured into bubble generation drinking cup 110. In some embodiments bubble generation drinking cup 110 is formed such that fluid 190 boils in response to cool or cold liquid 184 being poured into bubble generation drinking cup 110.

In some embodiments cup 110 includes insulating liner 136, as shown in FIG. 3 through FIG. 8. Insulating liner 136 accentuates the temperature differential within vacuum cavity 120 by minimizing thermal coupling between liquid 184 or 194 and inner cup sidewall 116.

In the embodiments of cup 110 shown in FIG. 1 through FIG. 7, thermal transfer path 134 thermally couples liquid 194 and cup bottom 112 to vacuum cavity bottom end 124 so that vacuum cavity bottom end 124 has an increase in temperature in response to warm or hot liquid 194 being placed into cup 110. In this embodiment insulating layer 136 minimizes heat transfer between hot liquid 194 and inner cup sidewall 116. Without using insulating liner 136, warm liquid 194 would tend to increase the temperature of inner cup sidewall 116 from top to bottom, which minimizes the temperature differential between vacuum cavity top end 122 and vacuum cavity bottom end 124. Optimum boiling and bubbling occurs when there is a large temperature differential between vacuum cavity top end 122 and vacuum cavity bottom end 124. Thus insulating liner 136 in this embodiment insulates inner cup sidewall 116, including inner cup sidewall inner surface 126 and inner cup sidewall outer surface 128, from thermal coupling with liquid 194 placed into cup 110. Insulating liner 136 can be any material that has low thermal transfer coefficient, minimizing heat transfer within the material. In some embodiment insulating liner 136 can be made of Styrofoam, for example but not by way of limitation. In some embodiments not shown, insulating liner 136 is replaced by a similar sized structure with an equal measure of insulation, such as two nested metal cylinders containing a hollow space, similar in principle to Dewar Flasks. Insulating liner 136 can be any material or structure that provides a means for insulation from thermal transfer.

In the embodiment of cup 110 shown in FIG. 8, thermal transfer path 134 thermally couples liquid 184 and upper portion 117 of vacuum cavity 120, so that vacuum cavity upper portion 117 has a decrease in temperature in response to cool or cold liquid 184 being placed into cup 110. In this embodiment insulating layer 136 minimizes heat transfer between cold liquid 184, shown in the figure including ice cubes 186, and cup bottom 112. Without using insulating liner 136, cold liquid 184 would tend to decrease the temperature of cup bottom 112 and vacuum cavity bottom end 124, which would minimize the temperature differential between vacuum cavity top end 122 and vacuum cavity bottom end 124. Optimum boiling and bubbling occurs when there is a large temperature differential between vacuum cavity top end 122 and vacuum cavity bottom end 124. Thus insulating liner 136 in this embodiment insulates cup bottom 112 and vacuum cavity bottom end 124 from thermal coupling with cold liquid 184 placed into cup 110.

In some embodiments cup 110 also includes cup liner layer 142, as shown in FIG. 5 through FIG. 7. Cup liner layer 142 is a layer of safe and hygienic material that provides a smooth and sanitary inner surface to cup 110, and provides an inert surface to contain liquid 194. Cup liner layer 142 can be used to protect the inner surface of insulating layer 136 and prolong the life of cup 110. Cup liner layer 142 can be metal, plastic, or other similar material.

The contents of vacuum cavity 120 can take many forms. In the embodiments shown in FIG. 3 through FIG. 8, vacuum cavity 120 includes first fluid 190, which boils and bubbles in response to a temperature differential between vacuum cavity top end 122 and vacuum cavity bottom end 124, as shown in FIG. 7 and FIG. 8. In some embodiments vacuum cavity 120 includes bubble nucleation device 160, as shown in FIG. 5 through FIG. 8. Bubble nucleation device 160 provides a convenient material for bubbles to seed or develop. Bubble nucleation device 160 can include glass wool, porous ceramic or stones, or other bubble nucleation devices. In some embodiments mobile bubble nucleation devices are contained within vacuum cavity 120. Mobile bubble nucleation devices move up and down within vacuum cavity 120 in response to forming and then releasing bubbles 162. In some embodiments mobile bubble nucleation devices are shaped in the form of animals, plants, or other forms with visual appeal.

In some embodiments vacuum cavity 120 includes first fluid 190 and second fluid 192, where first fluid 190 and second fluid 192 are immiscible (see FIG. 1 and FIG. 2). Using immiscible fluids 190 and 192 creates an interesting visual effect because bubbles 162 from first fluid 190 pass through second fluid 192 in their direction of travel toward vacuum cavity top end 122. In some embodiments first fluid 190 and second fluid 192 are dyed to have different colors. In some embodiments particles or floating objects are put in first fluid 190 and/or second fluid 192 to increase the visual effect. In some embodiments fluid 190 is water or alcohol, and can include dyes or dyed particles. Fluid 190 can be chosen with a boiling point at atmospheric pressure similar to that of water, so that immersing the whole cup in boiling water will not create a significant over-pressure within vacuum cavity 120. The vapor pressure of fluid 190 should be chosen to exhibit a several-fold increase in vapor pressure over the range of operating temperatures, which are often from 0 to 60 degrees Celsius Fluid 190 should further be chosen to be nontoxic, and may contain certain additives known from the prior art that inhibit biological growth and adjust factors such as polarity, surface tension and viscosity.

Second fluid 192 should be chosen to be chemically stable, to be immiscible with first fluid 190, and have significantly lower vapor pressure than fluid 190. In some embodiments second fluid 192 is a light machine oil, mineral oil, or a synthetic oil.

In some embodiments more than two fluids 190, 192 are used to create further layering effects and layers for bubbles 162 to pass through.

In some embodiments vacuum cavity 120 includes baffles within vacuum cavity 120 to direct, capture, or break up bubbles 162. Baffles can be formed of glass, plastic, metal, or other solid materials. In some embodiments vacuum cavity 120 includes spacer posts within vacuum cavity 120 to keep the sides of vacuum cavity 120 from bending or breaking. Spacer posts traverse the width of vacuum cavity 120 from inner cup outer sidewall 128 to outer cup inner sidewall 130 to maintain a specific distance between these two surfaces. Spacer posts can be made from glass, plastic, or other materials. The use of baffles and spacer posts is explained in more detail with respect to bubble generation vacuum panel 310 according to the invention, discussed later in this document.

In the embodiments shown, the one or more than one fluid 190, 192 partially fills vacuum cavity 120. This leaves an empty space above the one or more than one fluid 190, 192 within vacuum cavity 120, whose volume is partially or completely collapsed and shifted into the rising bubbles during operation. The visually appealing bubbling process is shown in FIG. 2, FIG. 7, and FIG. 8. I the embodiment shown in FIG. 2 and FIG. 7, a warm or hot liquid 194 is placed in cup 110. The warm or hot liquid 194 heats up cup bottom 112. Thermal transfer path 134 transfers heat from liquid 194 and cup bottom 112 to vacuum cavity bottom end 124. A temperature gradient forms between vacuum cavity bottom end 124 and vacuum cavity top end 122 in response to heat transfer path 134 transferring heat to vacuum cavity bottom end 124. First fluid 190 boils in response to the temperature gradient between vacuum cavity bottom end 124 and vacuum cavity top end 122. First fluid boiling creates bubbles 162. In some embodiments bubbles 162 form at bubble nucleation device 160. Bubbles 162 rise and then condense at the upper, cooler end of vacuum cavity 120, creating condensation droplets 164. If second fluid 192 is used, bubbles 162 pass through second fluid 192 from below, and condensation droplets 164 pass through second fluid 192 from above. The motion of bubbles 162 may also create interesting fluid flow and mixing of fluids 190 and 192. The extended boiling cycle creates a visually appealing look that can be enhanced with dyes, particles, mobile bubble nucleation sites, baffles, posts, inert fluids, physical obstacles or objects, or other items placed in vacuum cavity 120. Many different embodiments are possible using the described concepts. In some embodiments cup 110 includes an insulating base 166 for minimizing heat transfer between cup bottom 112 and a table or hands, for example.

FIG. 8 illustrates the similar bubbling process using a bubble generation cup 110 designed to generate bubbles 162 in response to receiving a cold liquid 184. In this embodiment thermal transfer path 134 transfers heat from the upper end of vacuum cavity 120 through upper portion 117 of inner cup sidewall 116 to cold liquid 184. This create a temperature differential between vacuum cavity top end 122 and vacuum cavity bottom end 124, and a corresponding temperature gradient within fluid 190, which initiates the generation of bubbles 162 within fluid 190.

It is to be understood that bubble generation drinking cup 110 according the invention can be made in many different sizes and shapes, and include many different variations of thermal transfer paths 134 which cause a thermal gradient in vacuum cavity 120, resulting in the generation of bubbles 162 in fluid 190.

Figure 9:
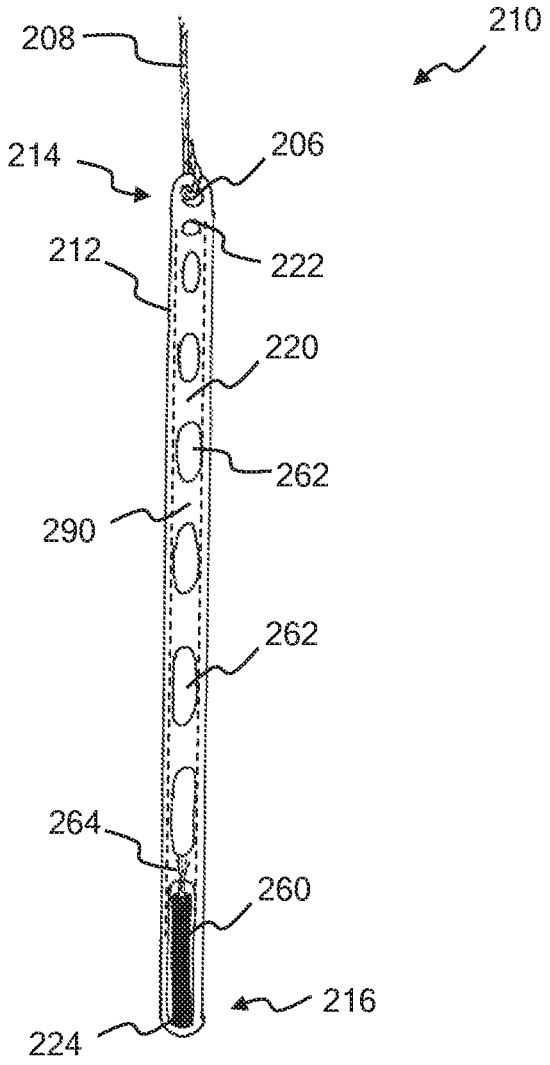
FIG. 9 shows a front view of an embodiment of vial bubble generation ornament 210 according to the invention.
Figure 10:
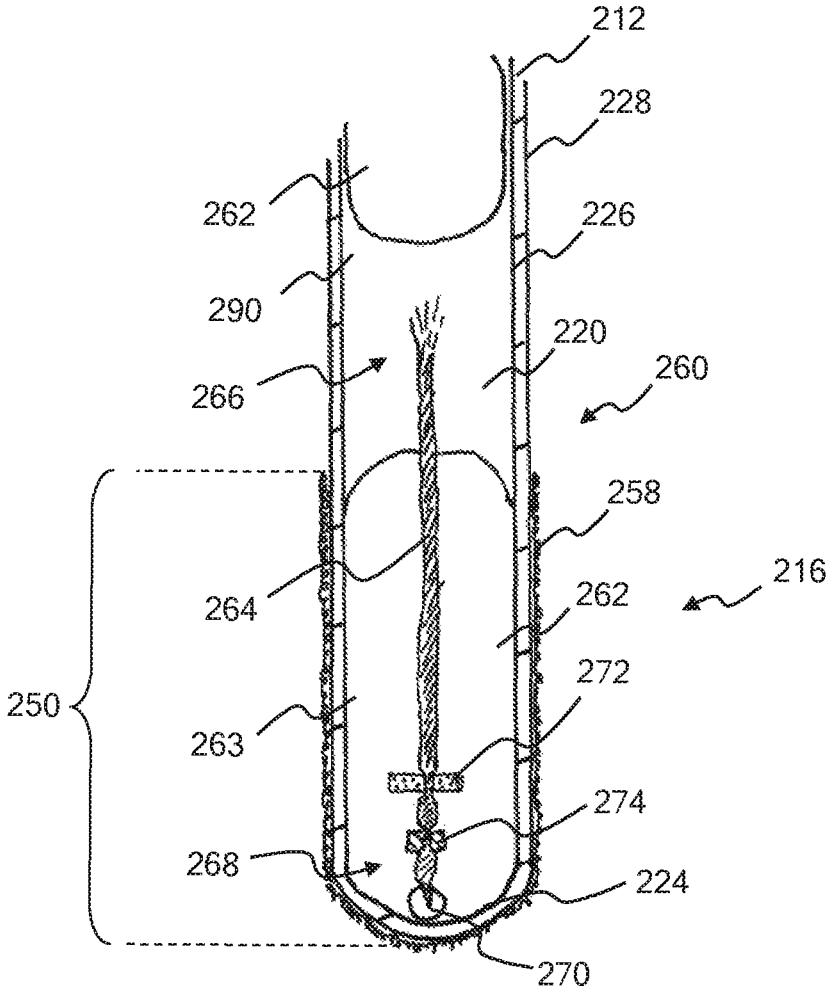
FIG. 10 shows a front cross-sectional view of an embodiment of bubble generation capsule 260 according to the invention.
Figure 11:
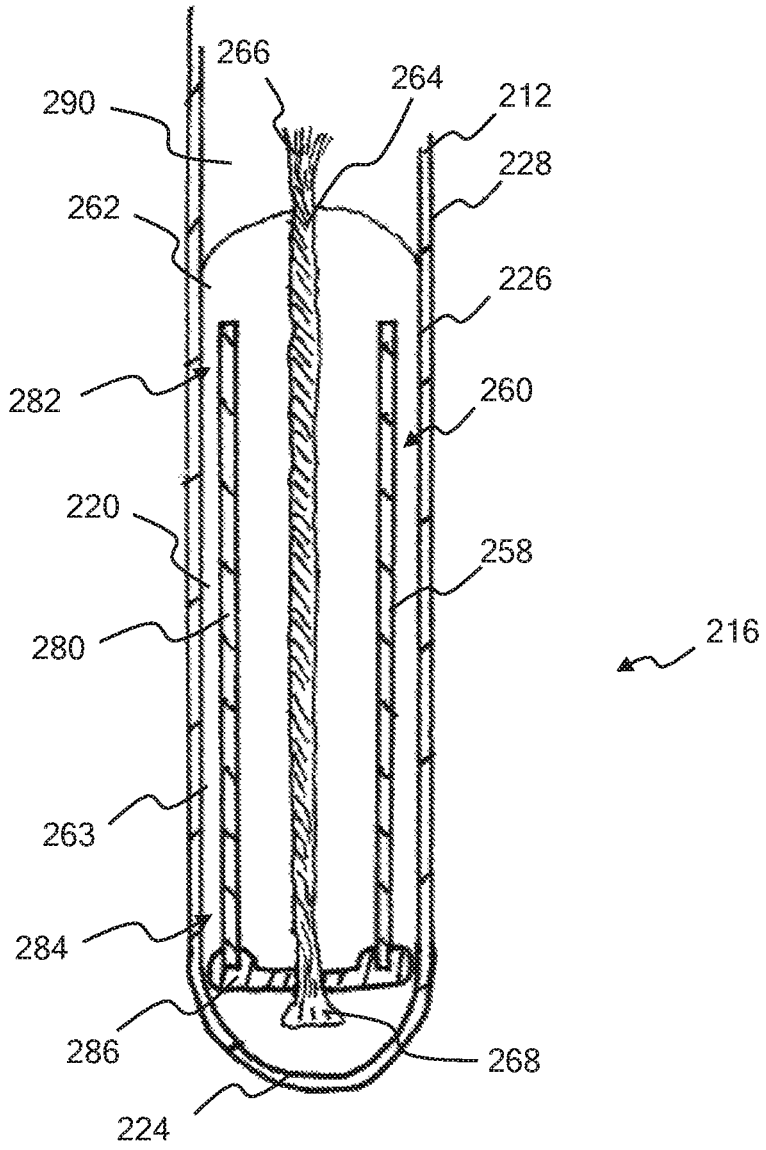
FIG. 11 shows a front cross-sectional view of another embodiment of bubble generation capsule 260 according to the invention.

FIG. 9 through FIG. 11 show embodiments of vial bubble generation ornament 210, another embodiment of a bubble generation novelty device according to the invention. Vial bubble generation ornament 210 generates bubbles that travel upwards within vial 210 in response to receiving sunlight. Vial bubble generation ornament 210 (vial ornament 210 or vial 210) includes hollow elongate vial wall 212 sealed at vial top end 214 and vial bottom end 216 to create a cavity enclosed by vial wall 212. The cavity is evacuated to create vacuum cavity 220. Vacuum cavity 220 is partially filled with fluid 290. Vacuum cavity 220 is only partially filled with fluid 290 because some empty space is desired at vacuum cavity top end 222 to accept bubbles 262. Bubble generator capsule 260 is enclosed within vacuum cavity 220. A temperature differential between vial top end 214 and vial bottom end 216 causes bubble generator capsule 260 to release bubbles 262 (not all of bubbles 262 are labeled in the drawing) into fluid 290. Bubble generator capsule 260 is designed to absorb heat from sunlight. Thus when bubble generator capsule 260 receives sunlight, bubble generator capsule 260 heats up, causing a temperature differential between vial top end 214 and vial bottom end 216. The temperature differential between vial top end 214 and vial bottom end 216 causes a corresponding temperature gradient within fluid 290. Bubble generator capsule 260 then releases bubbles 262, which travel upwards within vial wall 212. Thus bubble generator capsule 260 releases bubbles 262 into fluid 290 in response to receiving sunlight.

Hollow elongate vial wall 212 (vial wall 212) in this embodiment is an elongate hollow tube of transparent material such as glass, Plexiglas, or plastic. Vial wall 212 is often a thin narrow translucent tube with a diameter of between 3 and 10 mm. The diameter is small with respect to the overall length of vial wall 212 to discourage convective cooling within fluid 290 and encourage the generation of bubbles 262 instead. Vial wall 212 is hermetically sealed at vial top end 214 and vial bottom end 216, creating vacuum cavity 220 enclosed by vial wall 212. In the embodiment shown in FIG. 9 through FIG. 11, vial wall 212 is a long straight hollow tube with a circular cross section, but it is to be understood that vial wall 212 can have many hollow elongate shapes. Vial wall 212 can have an oval cross section, a star-shaped cross section, a square cross section, or any other shaped cross section which can be used to create an elongate tubular body with an enclosed vacuum cavity. In some embodiments vial wall 212 is bent or shaped into shapes such as a spiral or curved tube to add various visual effects. The long narrow shape of vial wall 212 inhibits convection within vial 210, and is of a sufficient length and low thermal conductivity for a significant thermal gradient to develop.

Vial 210 of FIG. 9 through FIG. 11 includes hole 206 at vial top end 214 so that vial 210 can be hung from string 208. With vial 210 positioned vertically or semi-vertically with respect to gravity, and with fluid 290 contained within vacuum cavity 220, a temperature differential between vial bottom end 216 and vial top end 214 will cause fluid 290 to boil, releasing bubbles 262 which rise from vial bottom end 216 to vial top end 214. It is desirable to control the formation of bubbles 262 to some extent. Slowly releasing large bubbles 262 whose diameter covers most of the diameter of vacuum cavity 220, is preferable to releasing small diameter bubbles 262, which would rise too quickly and cause undesirable fluid mixing. Bubbles 262 as created within vial 210 are uniquely defined by the adjusted surface tension, viscosity and polarity of fluid 290. This causes bubbles 262 to rise slowly, usually at rates from 0.5 centimeters per second to 3 centimeters per second. Bubbles 262 are limited in their rate of ascent by the amount of water that is able to flow past them in the thin surface film of fluid 290 that adheres to the inner side wall of the vial wall 212 when a bubble 262 is present. Bubble generation capsule 260 is used in vial 210 according to the invention to control and direct the formation of bubbles 260.

In some embodiments of vial 210, the composition of fluid 290 is adjusted to optimize bubble formation and movement within vacuum cavity 220. In some embodiments fluid 290 includes water and alcohol. In some embodiments fluid 290 is a mixture of water and 10 percent by volume of alcohol. In some embodiments fluid 290 includes water, alcohol and salt. In some embodiments fluid 290 includes 0.5 mole of an inorganic salt. These ingredients and ratios have been found to optimize the formation of bubbles 262, as well as the formation of a thin layer of fluid 290 along the inner wall of vacuum cavity 220, which allows bubbles 262 to rise within vacuum cavity 220, while still delivering fluid 290 to vacuum cavity bottom end 224 to feed the bubble generation process.

Bubble generation capsule 260 can take many forms. Bubble generation capsule 260 produces a stream of distinct rising bubbles 262 in response to absorbing heat, such as from sunlight, when bubble generation capsule 260 is placed in fluid 290 at bottom end 216 of vial 210. FIG. 10 and FIG. 11 show two different embodiments of bubble generation capsules 260 according to the invention. It is to be understood that many other types and embodiments of bubble generation capsules 260 according to the invention can be built.

In the embodiments of bubble generation capsule 260 shown in FIG. 9 through FIG. 11, bubble generation capsule 260 includes sunlight absorption layer 258 and wick 264 (see FIG. 10 and FIG. 11). In these embodiments vial 210 operates when held substantially vertically in the sunlight, such as by hanging from string 208, such that bubble generation capsule 260 is positioned at vial bottom end 216. As sunlight strikes vial 210, sunlight absorption layer 258 absorbs an order of magnitude more thermal energy than does the upper portion of vial 210, which is partially or fully transparent. Sunlight absorption layer 258 heats up in response to receiving sunlight, which heats bubble generation capsule 260. The heating of bubble generation capsule 260 causes a temperature differential and vapor pressure differential within fluid 290, which cannot be equalized from convection, and so is equalized by the formation of bubbles 262, which rise to the top of vial 210. There is usually also created a sessile bubble 263 which sits at the bottom of vial 210, releasing bubbles from the top end of sessile bubble 263 as vapor pressure develops. To encourage a continuous stream of bubbles 262, wick 264 is placed such that wick first end 268 sits at vacuum cavity bottom end 224 in sessile pocket 263, and wick second end 266 sits above the top end of sessile bubble 263 in fluid 290. Wick 264 continuously draws new fluid 290 into bubble generation capsule 260 and the heated lower end 216 of vial 210, feeding the vaporization and bubbling process. The vertical position of vial 210 causes bubbles 262 to slowly rise to the top of vial 210, growing smaller as they rise. The continuous rising of bubbles through vial 210 creates a pleasing visual effect in the sunlight. This visual effect can be enhanced with colored liquids, particles, dyes, or other additives in fluid 290, additional types of fluids included in vacuum cavity 220, as well as the shape and structure of vial wall 212.

FIG. 10 shows one embodiment of bubble generation capsule 260. In this embodiment, sunlight absorption layer 258 covers bottom portion 250 of vial wall outer surface 228. Sunlight absorption layer 258 is placed at bottom portion 250, which is at vial bottom end 216, because that is where it is desirable for the heating of fluid 290 to occur. Wick 264 in this embodiment includes weight 270, porous material 272, and non-polar material 274. In this embodiment porous material 272 is piece of soapstone 272. In this embodiment non-polar material 274 is piece of plastic material 274. Porous material 272 and non-polar material 274 can be used together, as shown in FIG. 10, or separately. Weight 270 holds wick first end 268 at vacuum cavity bottom end 224. Non-polar material 274 facilitates the forming of bubbles 262. Non-polar material 274 is used in conjunction with a polar fluid 290 in order to lower the initial state of vapor pressure supersaturation needed to initiate the formation of bubbles 262. Non-polar material 274 can be Teflon or other similar non-polar plastic material. Porous material 272 retains small quantities of vapor and also contributes to the formation of bubbles 262. Porous material 272 can be soapstone, fibers, or other porous substance, material, or device.

Vapor will be generated at wick first end 268 at or near non-polar material 274 or porous material 272 in response to sunlight absorption layer 258 absorbing heat. Bubbles 262 of vapor will separate from sessile bubble 263 and travel upwards from vial bottom end 216 to vial top end 214. Wick 264 brings fluid 290 from wick second end 266 to wick first end 268 to feed the bubble generation process. Wick 264 is needed to avoid a temperature extreme from vaporizing the surface film and creating a large stationary bubble at vial bottom end 216, which would inhibit further bubble formation. Bubbles 262 will continue to be generated as long as a temperature differential exists between vial top end 214 and vial bottom end 216.

FIG. 11 shows another embodiment of bubble generator capsule 260 according to the invention. In this embodiment bubble generator capsule 260 includes hollow tube of material 280, and hollow tub bottom cap 286. Hollow tube of material 280 is positioned inside vacuum cavity 220 at vial bottom end 216. Hollow tube of material 280 includes sunlight absorption layer 258. In some embodiments sunlight absorption layer 258 is a layer of heat-absorbing material covering the outer surface of hollow tube of material 280. In some embodiments sunlight absorption layer is a material comprised in hollow tube of material 280. Hollow tube of material 280 includes sunlight absorption layer 258 so that when hollow tube of material 280 receives sunlight, hollow tube of material 280 rises in temperature to begin the bubbling process.

Hollow tube of material 280 can be made of any material that is chemically inert in fluid 290 and absorbs heat well enough to cause fluid 290 to vaporize. Hollow tube of material 280 is formed of a diameter small enough to fit in vial bottom end 216 and large enough to contain wick 264. Hollow tube of material 280 has a length such that hollow tube top end 282 does not protrude from sessile bubble 263.

In the embodiment of bubble generation capsule 160 shown in FIG. 11, hollow tube of material 280 has hollow tube top end 282 and hollow tube bottom end 284. Bubble generator capsule 260 also includes hollow tube bottom cap 286 in this embodiment. Bottom cap 286 is coupled to hollow tube bottom end 284. Wick first end 268 is coupled to hollow tube bottom cap 286. Wick first end 268 is coupled to hollow tube bottom cap 286 in order for wick first end 268 to be positioned near vacuum cavity bottom end 224. In this embodiment bottom cap 286 is formed of a non-polar material so that bottom cap 286 facilitates the formation of bubbles 262. Wick second end 266 protrudes from hollow tube top end 282 so that wick second end 266 is positioned above sessile bubble 263 in fluid 290. Thus wick 264 delivers fluid 290 from above sessile bubble 263 to wick first end 268, where fluid 290 is converted into vapor at bottom cap 286. The vapor becomes bubbles 262 which rise to the top of vial 210 as explained earlier. This bubbling process continues as long as a temperature differential exists between vial top end 214 and vial bottom end 216.

Figure 12:
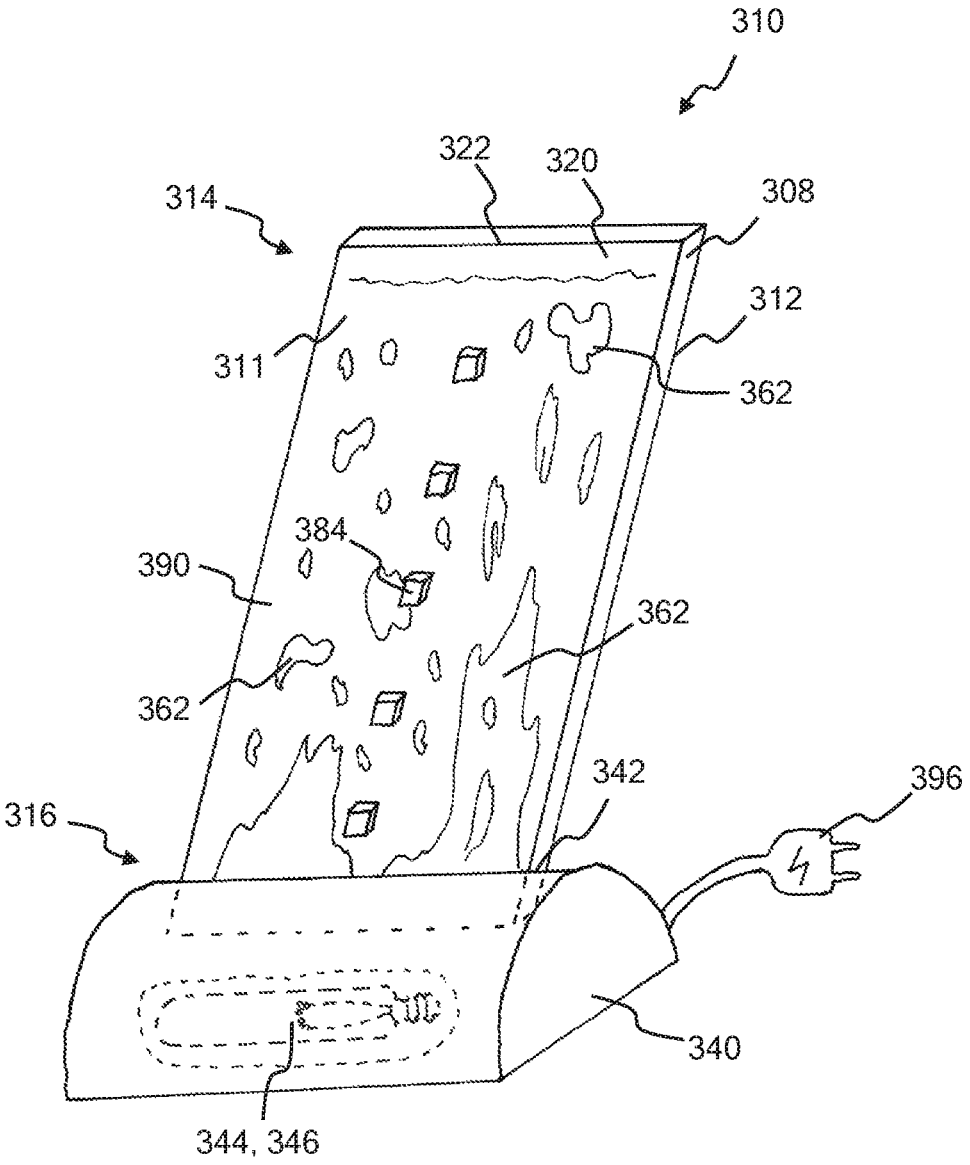
FIG. 12 shows a front perspective view of an embodiment of bubble generation panel 310 according to the invention.
Figure 13:
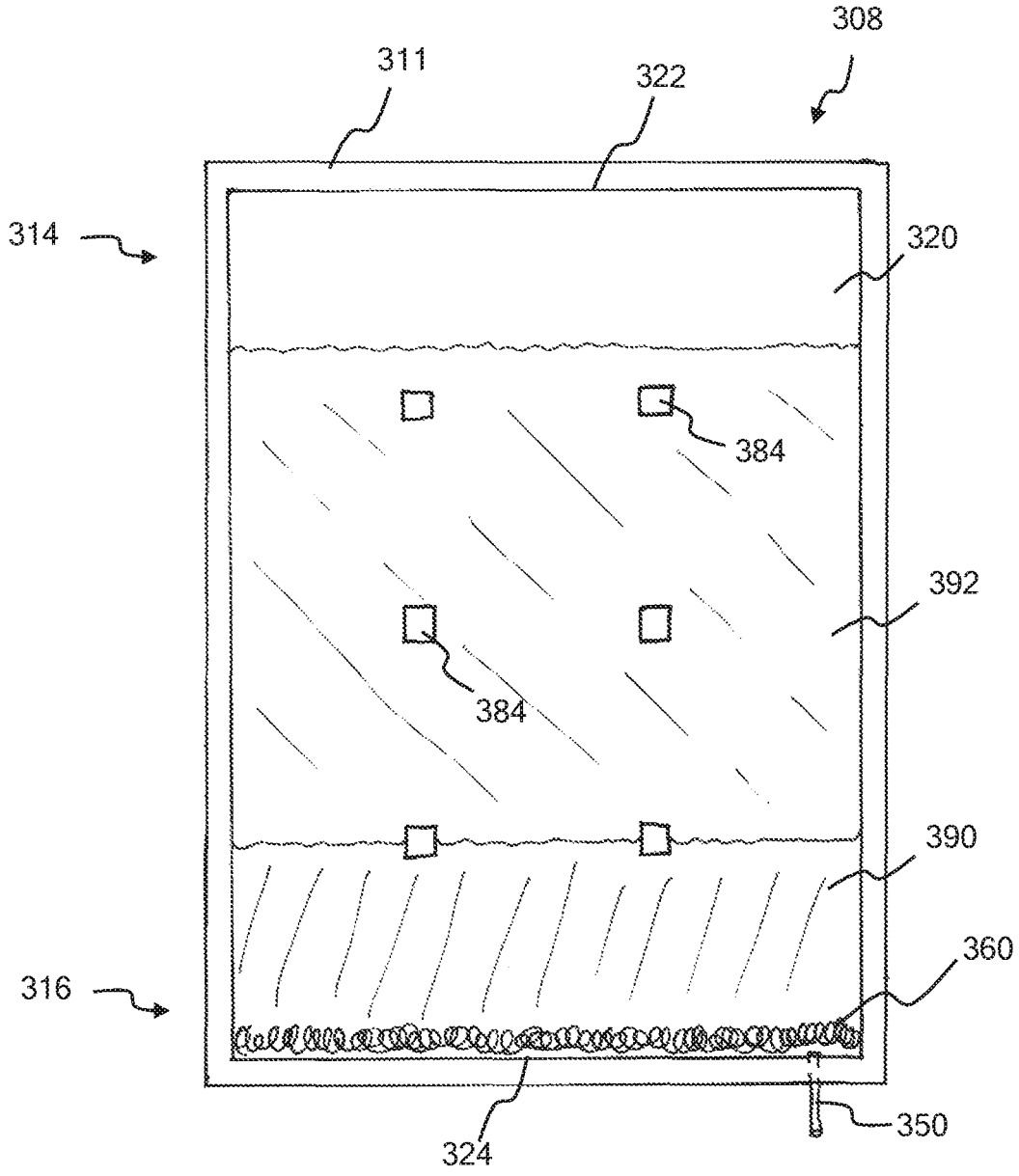
FIG. 13 shows a front view of one embodiment of vacuum panel 308 of bubble generation panel 310 of FIG. 12.
Figure 14:
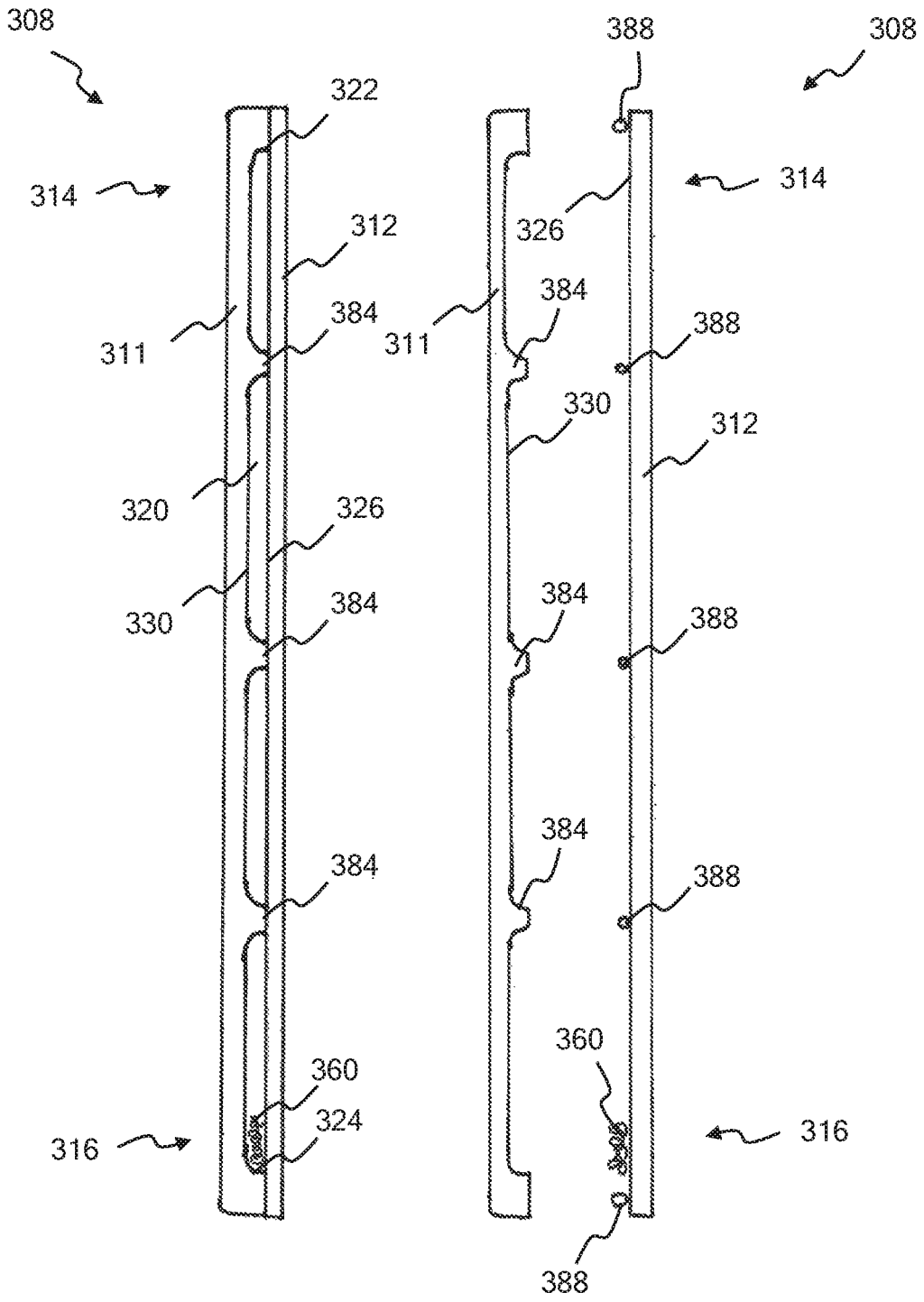
FIG. 14 shows a side cross-sectional view and a side exploded view of vacuum panel 308 of bubble generation panel 310 of FIG. 12
Figure 15:
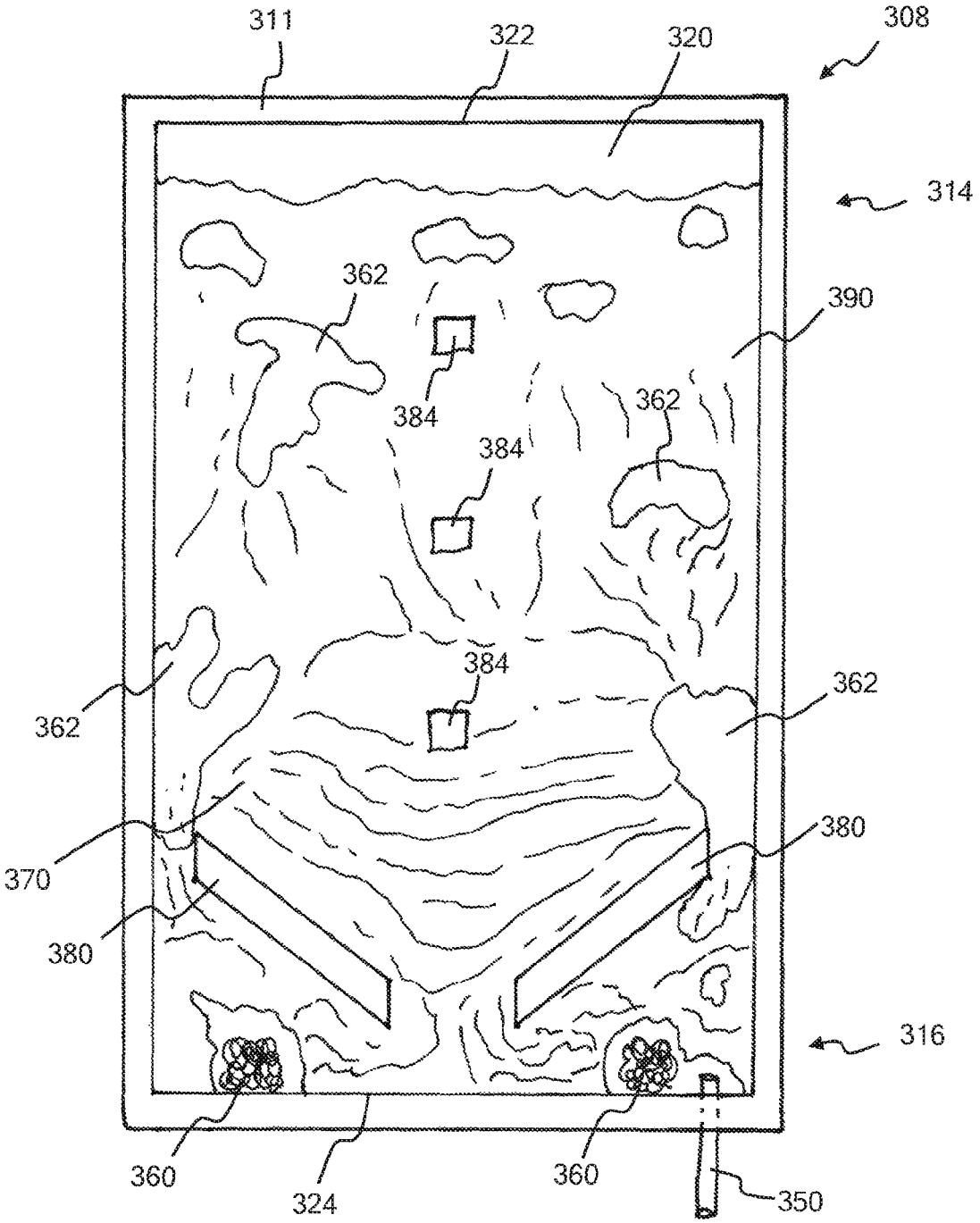
FIG. 15 shows a front view of another embodiment of vacuum panel 308 of bubble generation panel 310. In this figure fluid 390 is boiling, and generating bubbles 362, which travel upward past baffles 380 and through sand 370.

Another embodiment of a bubble generation novelty device described in this document is bubble generation panel 310. FIG. 12 through FIG. 15 show embodiments of bubble generation panel 310 according to the invention. FIG. 12 shows a front perspective view of one embodiment of bubble generation panel 310 according to the invention. FIG. 13 shows a front view of an embodiment of vacuum panel 308 that can be used in bubble generation panel 310 of FIG. 12. FIG. 14 shows a side cross section view and a side exploded view of vacuum panel 308 of FIG. 13. FIG. 15 shows another embodiment of vacuum panel 308 according to the invention that can be used with bubble generation panel 310 of FIG. 12.

Bubble generation panel 310 according to the invention as shown in FIG. 12 includes vacuum panel 308 and base 340. Vacuum panel 308 is held by base 340 in the embodiment shown in FIG. 12. Vacuum panel 308 includes front pane 311 and rear pane 312. Front pane 311 and rear pane 312 are panes of rigid material such as glass or plastic that are placed together and hermetically sealed around the edges to create vacuum cavity 320 between front pane 311 and rear pane 312. Front pane 311 and back pane 312 define vacuum cavity 320. Vacuum cavity 320 is defined by front pane 311 and rear pane 312 because the shape and distance between front pane 311 and rear pane 312 define the outer bounds of vacuum cavity 320. In the embodiments shown, front pane 311 and rear pane 312 are flat panes of transparent material, but it is to be understood that the invention is not limited in these aspects. Font pane 311 and rear pane 312 can be any size and shape that define a vacuum cavity between them. In some embodiments they are cylinders similar to the shapes used in bubble generation drinking cup 110 discussed earlier. In some embodiments front pane 311 and rear pane 312 are other shapes—spheres, cubes, pyramids, etc. Front pane 311 and rear pane 312 can be any combination of transparent, translucent, colored, textured or opaque material according to the visual effects desired. Front pane 311 is partially or fully transparent in the embodiments shown so that the bubbling action that will occur within vacuum panel 308 can be seen.

Vacuum panel 308 also includes one or more than one fluid within vacuum cavity 320. In the embodiment shown in FIG. 12, vacuum panel 308 includes first fluid 390 within vacuum cavity 320. First fluid 390 partially fills vacuum cavity 320. Vacuum panel 308 in the embodiments shown also includes one or more than one bubble nucleation device 360. Bubble nucleation device 360 facilitates the formation of bubbles 362 (several of many bubbles 362 labeled in the figures). Fluid 390 can be made to boil and create bubbles 362 in response to a temperature difference between different regions of vacuum panel 308, as will be explained shortly.

Base 340 is used to hold vacuum panel 308. Base 340 holds vacuum panel 308 in a position not parallel to the ground, so that bubbles generated within vacuum panel 308 will rise. Base 340 also facilitates light and heat being delivered to vacuum panel 308 if desired. Base 340 includes slot 342 for receiving bottom end 316 of vacuum panel 308. Slot 342 holds vacuum panel 308 and provides a base so that bubble generation panel 310 can be placed on a table or otherwise set out for viewing. Slot 342 holds vacuum panel 308 in a position such that gravity will cause bubbles 362 within vacuum cavity 320 to rise to one end or the other of vacuum panel 308. In the embodiment shown, base 340 holds vacuum panel 308 such that bubbles 362 rise to vacuum cavity top end 322, which is at vacuum panel top end 314.

Base 340 in the embodiment shown in FIG. 12 includes light source 344. Light source 344 emits light. The light emitted from light source 344 is incident on vacuum panel 308. The light increases the visual appeal of vacuum panel 308 when it is bubbling and boiling. In some embodiments base 340 does not include light source 344. In some embodiments base 340 also includes heat source 346 to create the temperature differential in vacuum panel 308 and fluid 390 by heating vacuum panel bottom end 316. In the embodiment shown, light source 344 is an incandescent light bulb, which provides heat and light, thus the light bulb is light source 344 and heat source 346. In some embodiments light source 344 and heat source 346 are two different devices. In some embodiments heat is provided to vacuum panel 308 from sunlight. In some embodiments base 340 includes a sunlight absorption device which heats up and provides heat to vacuum panel bottom end 316. Base 340 can take many different forms which provide holding of vacuum panel 308, light source 344 if desired, and heat source 346 if desired. Base 342 in the embodiment shown in FIG. 12 also encloses the electronics associated with light source 344 and heat source 346, and includes electrical plug 396 for delivering power to light source 344 and/or heat source 346.

Vacuum panel 308 can take many different forms, some of which are shown in FIG. 13 through FIG. 15. Vacuum panel 308 includes front pane 311 and rear pane 312, as shown in FIG. 14. Front pane 311 and rear pane 312 are hermetically sealed to create vacuum cavity 320 between front pane 311 and rear pane 312. Front pane 311 and rear pane 312 can be sealed using any suitable sealing material 388 such as solder glass, epoxy, adhesive, or any other method which is suitable to seal front pane 311 and rear pane 312 to create vacuum cavity 320. Vacuum cavity 320 is enclosed by front pane inner surface 330, rear pane inner surface 326, vacuum cavity top end 322 and vacuum cavity bottom end 324. In some embodiments either vacuum panel front pane 311 or vacuum panel rear pane 312 is partially or fully transparent to allow viewing of vacuum cavity 320.

Vacuum cavity 320 can be evacuated and sealed in any manner known in the art for creating a vacuum cavity, such as with the use of a hermetically sealed access port. This access port is used to fill vacuum cavity 320 with fluids, sand, or other elements that are contained in vacuum cavity 320. In some embodiments the hermetically sealed vacuum port takes the form of embedded metal straw 350 (see FIG. 13 and FIG. 15). Metal straw 350 has one end inside vacuum cavity 320 and one end outside vacuum cavity 320. After a vacuum device is used to evacuate vacuum cavity 320 until only the intended boiling fluid 390, it's vapor phase and any desired ornaments are present within vacuum cavity 320, metal straw 350 can be hermetically sealed, or metal straw 350 can be removed and the hole hermetically sealed. In some embodiments a glass straw is used instead of metal straw 350.

In the embodiments of vacuum panel 308 shown in FIG. 12 through FIG. 15, vacuum panel 308 includes spacer posts 384. Spacer posts 384 are used to keep front pane 311 and rear pane 312 at a specific distance from one another and to prevent the panes from bending towards or away from each other and possibly cracking or otherwise compromising vacuum cavity 320. In particular, spacer posts 384 provide structural support against the significant atmospheric pressure on front pane 311 and rear pane 312. In some embodiments spacer posts 384 are not used. In the embodiment of vacuum panel 308 shown in FIG. 12 and FIG. 13, spacer posts 384 are formed as an integral part of front pane 311, as shown in FIG. 14. In some embodiments spacer posts 384 are formed as an integral part of rear pane 312. In some embodiments spacer posts 384 are formed as separate pieces from either front pane 311 or rear pane 312.

In the embodiments of vacuum panel 308 shown in FIG. 12 through FIG. 15, vacuum panel 308 includes one or more than one bubble nucleation device 360. Bubble nucleation devices 360 are a material or structure which facilitates the generation of bubbles 362 in fluid 390. In some embodiments bubble nucleation devices 360 are a non-polar material. In some embodiments bubble nucleation devices 360 are a porous material. In some embodiments bubble nucleation device 360 is glass wool. In some embodiments bubble nucleation device 360 is metal foil. In some embodiments bubble nucleation device 360 is a resistor that inductively creates heat. In some embodiments bubble nucleation devices 360 are positioned at vacuum cavity bottom end 324, as shown in the figures. In some embodiments bubble nucleation devices 360 are mobile. In some embodiments bubble nucleation devices rise and fall within fluid 390 in vacuum cavity 320 as they form and then release bubbles 362. In some embodiments bubble nucleation devices 360 are shaped as animals, plants, or other decorative items.

Vacuum cavity 320 includes one or more than one fluid, where the one or more than one fluid partially fills vacuum cavity 320. In the embodiment of vacuum panel 308 shown in FIG. 12, vacuum panel 308 includes first fluid 390. First fluid 390 is generally chosen to be a fluid which is a liquid at room temperature, which does not create a dangerous over-pressure within the operating temperature range of vacuum panel 308, and is non-toxic. When vacuum panel 308 is placed in base 340 and heat source 346 is turned on, bottom end 316 of vacuum panel 308 is heated, creating a temperature differential between vacuum panel top end 314 and vacuum panel bottom end 316. The temperature differential between vacuum panel top end 314 and vacuum panel bottom end 316 causes a temperature gradient within first fluid 390. First fluid 390 will begin to boil in response to this temperature gradient. Bubbles 362 form at bubble nucleation sites 360. Bubbles 362 rise, due to gravity, from vacuum panel bottom end 316 to vacuum panel top end 314. Light source 344 lights first fluid 390 and bubbles 362, creating a visually pleasing effect as first fluid 390 boils and lighted bubbles 362 travel upward within vacuum cavity 320, further creating interesting flow patterns within fluid 390 as bubbles travel through it.

In some embodiments more than one light source 344 is used to create pleasing light effects. Light source 344 can be any light-emitting device including but not limited to light bulbs, lasers, light-emitting diodes, or any other light emitting material or device.

In some embodiments the heat needed to cause first fluid 390 to boil is created by the sun. Base 340 can include a sunlight absorption layer, or a particular portion of vacuum panel 308 can include a sunlight absorption layer. The sunlight absorption layer can be used to absorb sunlight and heat a certain area or portion of vacuum panel 308, providing the thermal power for the continuous process of bubble creation.

In some embodiments vacuum cavity 320 includes more than one fluid. Vacuum panel 308 as shown in FIG. 13 includes first fluid 390 and second fluid 392. In this embodiment first fluid 390 and second fluid 392 are immiscible. In the embodiment shown in FIG. 13, first fluid 390 will create bubbles 362 in response to a temperature gradient. Bubbles 362 will travel upwards through first fluid 390 and second fluid 392, causing specific visual effects. First fluid 390 and second fluid 392 can have different colors, for instance, or can include different additives such as particles, dyes, or floating elements.

In some embodiments vacuum cavity 320 includes other elements. Vacuum panel 308 according to the invention as shown in FIG. 15 includes vacuum cavity 320, where vacuum cavity 320 includes baffles 380 and sand 370. Baffles 380 are devices within vacuum cavity 320 which block, break up, or direct bubbles 362. Baffles 380 can be used to direct bubbles 362 into particular directions or patterns. Baffles 380 can be made of glass, plastic, or other suitable material. Baffles 380 can be formed into shapes or patterns to enhance the visual effect of bubbles rising around them. In the embodiment shown in FIG. 15, baffles 380 also serve a similar purpose as the spacer posts 384 in providing structural stability to the panel.

Sand 370 creates an element that bubbles 362 have to pass through in their travels upwards, creating interesting and striking visual effects. In some embodiments sand 370 is a mixture of different size, color, and density particles that create sedimentary patterns. The different types of sand 370 are displaced by bubbles 362 as bubbles 362 pass through sand 370, causing various patterns to be created as sand 370 falls back down. In some embodiments sand 370 has devices or patterns included in sand 370.

Vacuum cavity 320 can include many other elements which enhance or change the visual effect of bubbles and the fluid flow caused by their movement, including color elements, different types of fluids, devices, toys, baffles, bubble directors, light reflectors or directors, etc. Vacuum panel 308 is shown as a rectangle in the figures, but it is to be understood that vacuum panel 308 can be any size or shape that can be made to enclose a vacuum cavity, including curves, nested cylinders, globes, etc. Vacuum cavity 320 can be made in any size or shape between front pane 311 and rear pane 312.

Several different types and embodiments of bubble generation novelty devices have been described and shown in the drawings. Each of these embodiments encapsulate a fluid within a vacuum cavity, and then use a thermal gradient within the vacuum cavity to boil the fluid, generating bubbles. The bubbles can be made to create interesting and visually appealing patterns within the device. It is to be understood that many different variations of bubble generation novelty devices according to the invention can be made using the principles described herein. The particular embodiments described and shown are not meant to limit the invention.

Figure 16:
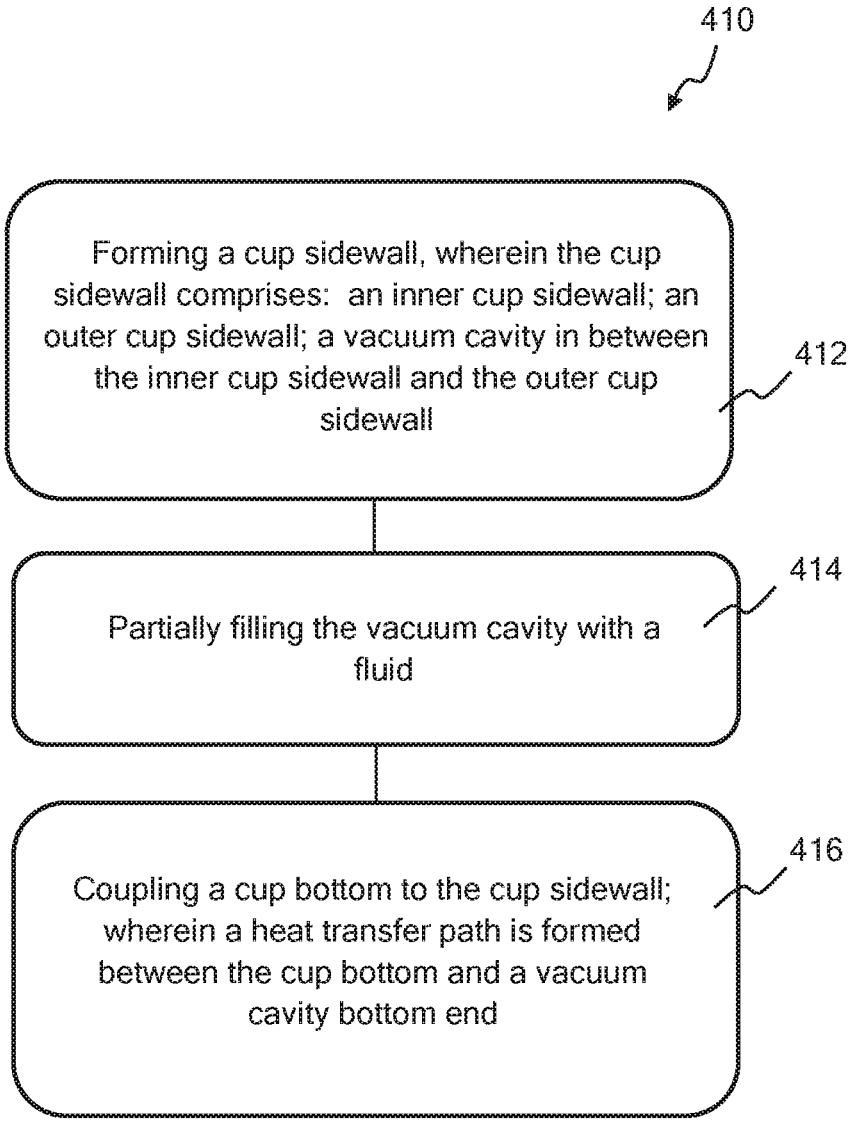
FIG. 16 illustrates method 410 of forming a bubble generation cup novelty item according to the invention.

FIG. 16 illustrates method 410 of forming a bubble generation cup according to the invention. Method 410 of forming a bubble generation cup according to the invention includes step 412, forming a cup sidewall, where the cup sidewall includes an inner cup sidewall, an outer cup sidewall, and a vacuum cavity in between the inner cup sidewall and the outer cup sidewall. Method 410 of forming a bubble generation cup according to the invention also includes step 414 of partially filling the vacuum cavity with a fluid. Method 410 of forming a bubble generation cup according to the invention also includes step 416 of coupling a cup bottom to the cup sidewall, where a heat transfer path is formed between the cup bottom and a vacuum cavity bottom end. Method 410 according to the invention can include many other steps. In some embodiments method 410 includes the step of evacuating the vacuum cavity. In some embodiments method 410 includes the step of partially filling the vacuum cavity with a second fluid. In some embodiments method 410 includes the step of lining the cup sidewall with an insulating liner. In some embodiments method 410 includes the step of lining the insulating liner with a cup liner layer. In some embodiments method 410 includes the step if placing a bubble nucleation device inside the vacuum cavity.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A drinking cup comprising:

a cup bottom;

a cup sidewall comprising:

an inner cup sidewall, wherein the inner cup sidewall comprises an inner cup sidewall inner surface and an inner cup sidewall outer surface;

an outer cup sidewall, wherein the outer cup sidewall comprises an outer cup sidewall inner surface and an outer cup sidewall outer surface;

a vacuum cavity evacuated to create a vacuum therein, wherein the vacuum cavity is enclosed by the outer cup sidewall inner surface, the inner cup sidewall outer surface, a vacuum cavity top end, and a vacuum cavity bottom end;

and a first liquid, wherein the first liquid partially fills the vacuum cavity;

and a heat transfer path, wherein the heat transfer path thermally couples contents of the drinking cup to the vacuum cavity; and wherein the first liquid boils in response to the thermal coupling.

2. The drinking cup of claim 1 wherein bubbles produced from the boiling are visible through the outer cup sidewall.

3. The drinking cup of claim 1, wherein the first liquid boils continuously as long as the temperature difference between the cup contents and the outside environment acting on the outer cup sidewall create a sufficient thermal gradient across the vacuum cavity.

4. The drinking cup of claim 1, wherein one or both of the cup sidewalls are at least partially transparent.

5. The drinking cup of claim 1, wherein the contents of the cup are initially at a temperature substantially different from the temperature of the first liquid.

6. The drinking cup of claim 4, wherein the contents of the cup are initially at a temperature above the temperature of the first liquid such that the thermal coupling raises the temperature of the first liquid, which leads to boiling within the vacuum cavity.

7. The drinking cup of claim 4, wherein the contents of the cup are initially at a temperature below the temperature of the first liquid such that the thermal coupling lowers the temperature at the top of the vacuum cavity so as to permit the first liquid to boil.

8. The drinking cup of claim 1, further comprising an insulating liner, wherein the insulating liner is disposed between the cup contents and the inner cup sidewall, and wherein the insulating liner minimizes thermal coupling between the contents in the drinking cup and the vacuum cavity.

9. The drinking cup of claim 1, further comprising an insulating liner, wherein the insulating liner covers the inner cup sidewall, and wherein the thermal path thermally couples the cup contents to a bottom portion of the vacuum cavity.

10. The drinking cup of claim 1, further comprising an insulating liner, wherein the insulating liner covers the cup bottom, and wherein the thermal path thermally couples the cup contents to a top portion of the vacuum cavity.

11. The drinking cup of claim 1, further comprising a cup liner layer, wherein the cup liner layer covers the inner cup sidewall and insulating liner.

12. The drinking cup of claim 1, wherein the liquid is a first liquid, and wherein the cup sidewall further comprises a second liquid inside the vacuum cavity, wherein the first liquid and the second liquid are substantially immiscible.

13. The drinking cup of claim 1, further comprising visual enhancing material wherein the visual enhancing material partially fills the vacuum cavity.

14. The drinking cup of claim 1, further comprising granular material wherein the granular material partially fills the vacuum cavity.

15. The drinking cup of claim 1, wherein the cup sidewall further comprises one or more than one bubble nucleation devices disposed inside the vacuum cavity.

16. The drinking cup of claim 1, wherein the cup sidewall further comprises one or more spacers disposed inside the vacuum cavity.

17. The drinking cup of claim 1, wherein the cup sidewall further comprises one or more baffles disposed inside the vacuum cavity.

18. A drinking cup comprising:

a cup bottom;

a cup sidewall comprising:

an inner cup sidewall, wherein the inner cup sidewall comprises an inner cup sidewall inner surface and an inner cup sidewall outer surface;

an outer cup sidewall, wherein the outer cup sidewall comprises an outer cup sidewall inner surface and an outer cup sidewall outer surface;

a vacuum cavity including a plurality of spacers, the vacuum cavity disposed between the inner cup sidewall and the outer cup sidewall, wherein the vacuum cavity is enclosed by the outer cup sidewall inner surface, the inner cup sidewall outer surface, a vacuum cavity top end, and a vacuum cavity bottom end; and a liquid, wherein the liquid partially fills the vacuum cavity;

and a heat transfer path, wherein the heat transfer path thermally couples contents of the drinking cup to vacuum cavity, wherein the liquid boils in response to the thermal coupling creating a visual effect visible through the outer cup sidewall.

19. A drinking cup comprising:

a drinking cup including a vacuum cavity disposed within a sidewall of the cup, the vacuum cavity partially filled with a liquid;

wherein a heat transfer path is formed when contents of the cup are at a temperature substantially different from a temperature of the liquid in the vacuum cavity, the heat transfer path thermally coupling the contents of the cup to the liquid in the vacuum cavity, wherein the liquid boils in response to the thermal coupling creating a visual effect visible through an outer surface of the cup.

* * * * *